US012258187B2

(12) United States Patent
Pell et al.

(10) Patent No.: US 12,258,187 B2
(45) Date of Patent: Mar. 25, 2025

(54) PRODUCT PACKAGING WITH INTERNAL LIGHTING ASSEMBLY

(71) Applicant: ACCUBOW LLC, Peru, IL (US)

(72) Inventors: Matthew Allen-Tesch Pell, Plainfield, IL (US); Cody D. Grandadam, Hennepin, IL (US)

(73) Assignee: Promier Products Inc., Peru, IL (US)

( * ) Notice: Subject to any disclaimer, the term of this patent is extended or adjusted under 35 U.S.C. 154(b) by 440 days.

(21) Appl. No.: 17/790,322

(22) PCT Filed: Jan. 7, 2021

(86) PCT No.: PCT/US2021/012551
§ 371 (c)(1),
(2) Date: Jun. 30, 2022

(87) PCT Pub. No.: WO2021/142161
PCT Pub. Date: Jul. 15, 2021

(65) Prior Publication Data

US 2023/0057440 A1 Feb. 23, 2023

Related U.S. Application Data

(60) Provisional application No. 62/957,908, filed on Jan. 7, 2020.

(51) Int. Cl.
*B65D 5/42* (2006.01)
*A47F 3/00* (2006.01)
(Continued)

(52) U.S. Cl.
CPC ..... *B65D 5/4204* (2013.01); *A47F 3/001* (2013.01); *B65D 5/4208* (2013.01);
(Continued)

(58) Field of Classification Search
CPC .. B65D 5/4204; B65D 5/4208; B65D 5/5088; B65D 25/108; B65D 77/0433;
(Continued)

(56) References Cited

U.S. PATENT DOCUMENTS 1,514,505 A 11/1924 Brunhoff
3,168,192 A 2/1965 Nicholson et al.
(Continued)

FOREIGN PATENT DOCUMENTS

CN 209582173 U 11/2019
CN 210527288 U 5/2020

OTHER PUBLICATIONS

"18x18x4.4cm velvet LED jewelry box necklace earring ring gift box jewellery set display storage case," accessed on-line at: https://www.aliexpress.com/i/4000711097408.html on Dec. 17, 2020.
(Continued)

*Primary Examiner* — Kevin Quarterman
(74) *Attorney, Agent, or Firm* — Barnes & Thornburg LLP

(57) ABSTRACT

A product package or packaging is configured such that: (i) the product(s) are obscured from a potential buyer's view when the product package 10 is in a closed position and (ii) the product(s) becomes visible to the potential buyer when an extent of the product package is in a partially opened position. Once the product(s) becomes visible to the potential buyer, an illumination assembly illuminates the product (s). This selective illumination of the product(s) permits: (i) the illumination assembly to be battery powered, (ii) highlights features and attributes of the product(s) in order to attract and keep the potential buyer's attention, and (iii) makes it easier to see the product(s) within the product package, which helps prevent potential buyers from remov-
(Continued)

ing the product(s) from the package thereby reducing the chance that the product is inadvertently damaged.

27 Claims, 28 Drawing Sheets

(51) Int. Cl.

| | |
|---|---|
| ***B65D 5/50*** | (2006.01) |
| ***B65D 25/10*** | (2006.01) |
| ***B65D 77/04*** | (2006.01) |
| ***F42B 39/00*** | (2006.01) |

(52) U.S. Cl.
CPC ..... *B65D 5/5088* (2013.01); *B65D 25/108* (2013.01); *B65D 77/0433* (2013.01); *F42B 39/007* (2013.01); *B65D 2203/12* (2013.01); *B65D 2313/02* (2013.01); *B65D 2313/04* (2013.01)

(58) Field of Classification Search
CPC ..... B65D 2203/12; B65D 2313/02; B65D 2313/04; A47F 3/001; F42B 39/007
See application file for complete search history.

(56) References Cited

U.S. PATENT DOCUMENTS

| | | | | |
|---|---|---|---|---|
| 6,568,828 | B2 | 5/2003 | Rudoy | |
| 7,163,307 | B1 | 1/2007 | Clark et al. | |
| 9,526,148 | B2 | 12/2016 | Lowenthal et al. | |
| 10,625,530 | B2 | 4/2020 | Nelson | |
| 2007/0133195 | A1 | 6/2007 | Gorton | |
| 2010/0089786 | A1* | 4/2010 | Chang | B65D 5/4212 220/500 |
| 2014/0340879 | A1 | 11/2014 | Liu | |
| 2019/0045896 | A1 | 2/2019 | Leitermann | |

OTHER PUBLICATIONS

"Stock pink led ring box proposal ring box wedding jewelry box necklace bracelet box set," accessed on-line at: https://shopee.com.my/Stock-Pink-Led-Ring-Box-Proposal-Ring-Box-Wedding-Jewelry-Box-Necklace-Bracelet-Box-Set-i.162583547253386862 on Dec. 17, 2020.

"Velvet LED lights jewelry set gift boxes wedding bride elegant ring earring necklace pendant storage organizer display case," accessed on-line at: https://www.aliexpress.com/item/4000897402332.html on Dec. 17, 2020.

Search Report & Written Opinion issued in Int'l Appl. No. PCT/US2021/012551 (2021).

* cited by examiner

PRODUCT PACKAGING WITH INTERNAL LIGHTING ASSEMBLY

CROSS-REFERENCE TO RELATED APPLICATIONS

This Application is a U.S. nationalization under 35 USC § 371 of International Application No. PCT/US2021/012551, filed Jan. 7, 2021, which, claims the benefit of U.S. Provisional Patent Application No. 62/957,908, filed on Jan. 7, 2020, The disclosures set forth in the referenced applications are incorporated herein by reference in their entireties.

TECHNICAL FIELD

This disclosure relates to product packaging with an internal lighting assembly. In particular, the product packaging includes a housing with a support assembly, at least one product coupled to the support assembly and an internal illumination assembly that illuminates the product when a potential buyer moves a portion of the housing to reveal the product through a display window of the housing.

BACKGROUND OF THE INVENTION

Product packaging typically serves two primarily purposes: (i) protecting the product during shipping and handling, and (ii) providing information regarding the product(s within the packaging), including its features and attributes, to a potential buyer. To attract potential buyers and discourage them from opening the packaging to access and view the product therein, conventional packaging has been designed with features that allow the potential buyers to view or touch the product while it remains within the packaging. For example, conventional packaging can include a display window or clear segment that allows a potential buyer to visually inspect the product residing within the packaging. Conventional packaging that allows a potential buyer to view, touch, or interact with the product has drawbacks, for example a large form factor or bulky configuration, that increase the manufacturing costs and/or shipping costs of the conventional packaging while reducing its ability to be displayed on store shelves.

A type of conventional packaging known as a "reveal-type package" retains the product entirely within the packaging and reveals a limited extent of the product therein. The reveal package is designed with a shape that allows for efficient shipment, where the product is protected from shipping and handling-related damage because the product is fully enclosed within the package. The product only becomes visible for inspection when a buyer moves a limited extent of the packaging from a closed position to an open position. While this packaging type provides some significant benefits over other conventional packaging types, the buyer may still have trouble viewing the product and/or understanding all of the product's features and attributes because it is fully enclosed within the packaging and thus an insufficient amount of light enters the packaging to illuminate the product therein. This hampers the buyer's ability to understand all of the product's features and attributes and as a result, the buyer is less likely to purchase the product.

Accordingly, there is an unmet need for an improved reveal-type package that includes an internal lighting assembly designed to efficiently and effectively illuminate the product within the package and thereby provide the buyer with an opportunity to fully understand all of the product's features and attributes. A full discussion of the features and advantages of the present invention is deferred to the following detailed description, which proceeds with reference to the accompanying drawings.

SUMMARY

In some implementations, the present disclosure provides a product package with an internal illumination assembly. The product package includes: (i) housing, (ii) support assembly, and (iii) illumination assembly. The housing has an arrangement of walls that define a container, a movable concealing flap and at least one display window, while the support assembly removably positioned within the container and the illumination assembly coupled to the support assembly, the illumination assembly configured to selectively illuminate the product. The housing has at least two positions, which include a closed position and a partially open position. When the housing is in a closed position, the concealing flap overlies the display window to obscure the product and the illumination assembly is not illuminating the product. When the housing is in a partially open position, the concealing flap is deployed from the display window to expose the product and the illumination assembly is illuminating the product.

The concealing flap includes a triggering means and the illumination assembly including a switching means, wherein: (i) when the triggering means is coupled to the switching means, the housing is in the closed position and (ii) when the triggering means is uncoupled from the switching means, the housing is in the partially open position or a fully open position. The interaction between the triggering means and the switching means applies a biasing force on the concealing flap to retain the concealing flap in contact with a front wall of the housing. When an uncoupling force that may have a curvilinear component is applied on the concealing flap that is greater than the biasing force, the state of the housing moves from the closed position to the partially opened position.

The product is releasably coupled to the support assembly. The product may be type of consumer good, such as broadheads, flashlights, jewelry, glassware, electronics, watches, alcohol, perfumer, or shoes. The illumination assembly includes a printed circuit board with a plurality of light emitters disposed thereon. The light emitter are positioned below and behind an extent of the product in order to backlight the product and accent the product's features. To further help ensure that the products are properly illuminated, at least one light emitter from the plurality of light emitters is positioned between each pair of products from plurality of products.

Other features and advantages of the invention will be apparent from the following specification taken in conjunction with the following drawings.

BRIEF DESCRIPTION OF THE DRAWINGS

The drawing figures depict one or more implementations in accord with the present teachings, by way of example only, not by way of limitation. In the figures, like reference numerals refer to the same or similar elements.

Figure 1:
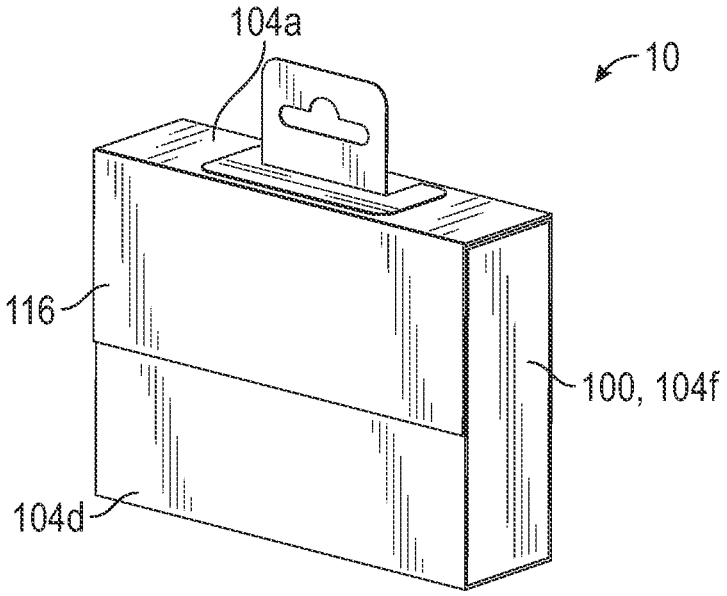
FIG. 1 is a perspective view of a first embodiment of a product package with an internal illumination assembly, the product package being in a closed position or ready to ship state.
Figure 2:
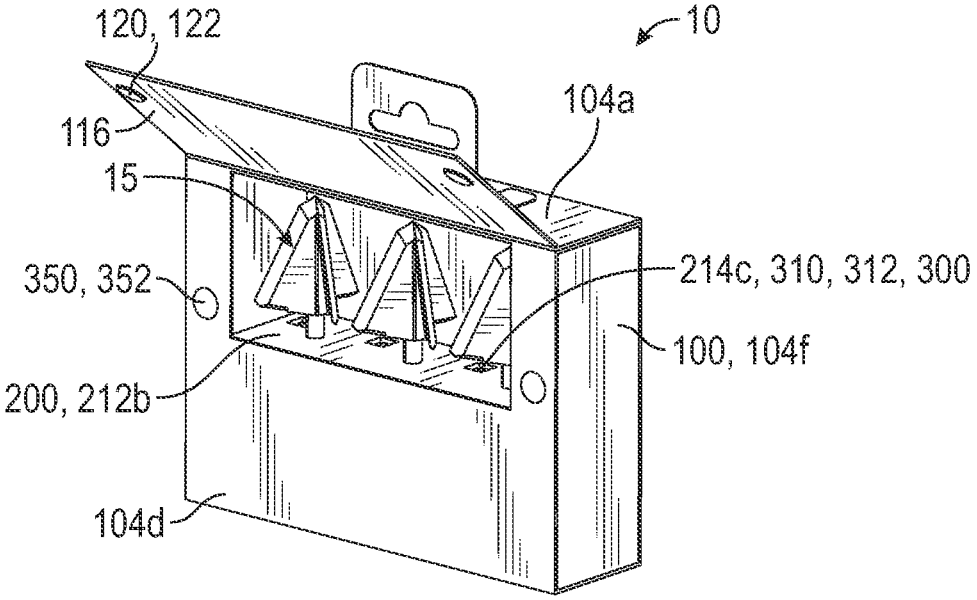
FIG. 2 is a perspective view of the product package of FIG. 1, wherein a flap segment of the product package is moved from the closed position to a partially open position in order to view the products residing within the housing of the package.
Figure 3:
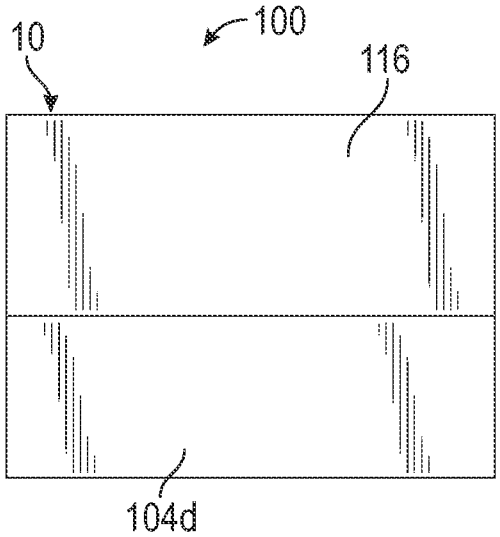
FIG. 3 is a front view of the product package of FIG. 1.
Figure 4:
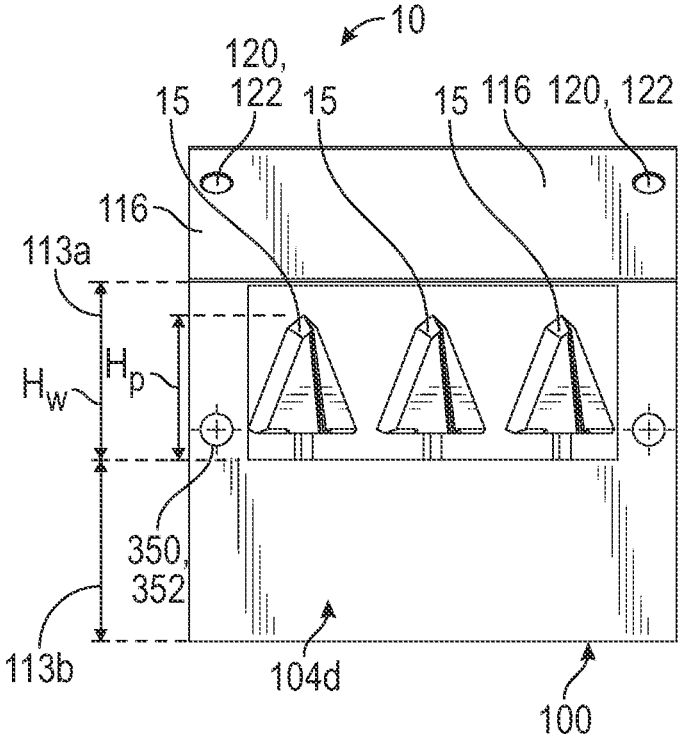
FIG. 4 is a front view of the product package of FIG. 2.
Figure 5:
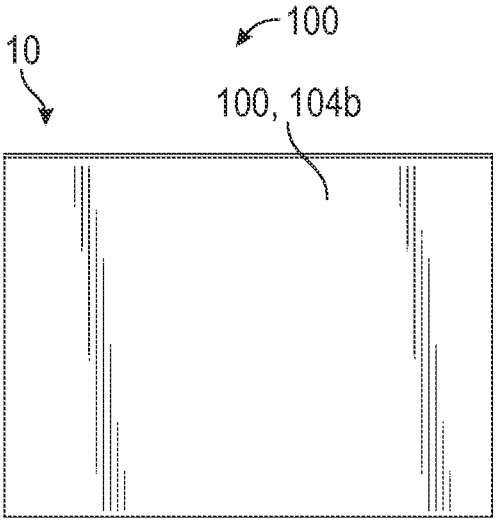
FIG. 5 is a rear view of the product package of FIG. 1.
Figure 6:
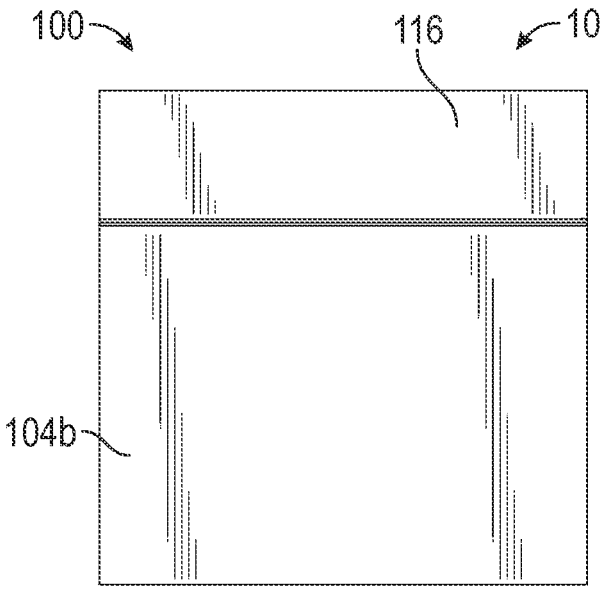
FIG. 6 is a rear view of the product package of FIG. 2.
Figure 7:
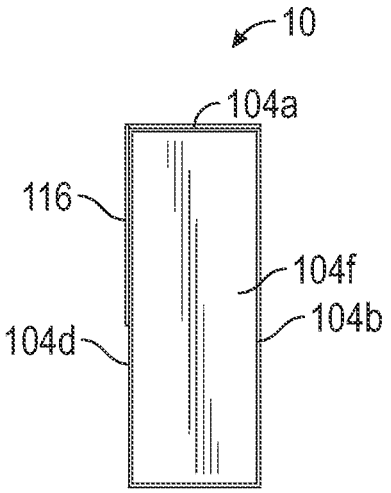
FIG. 7 is a right side view of the product package of FIG. 1.
Figure 8:
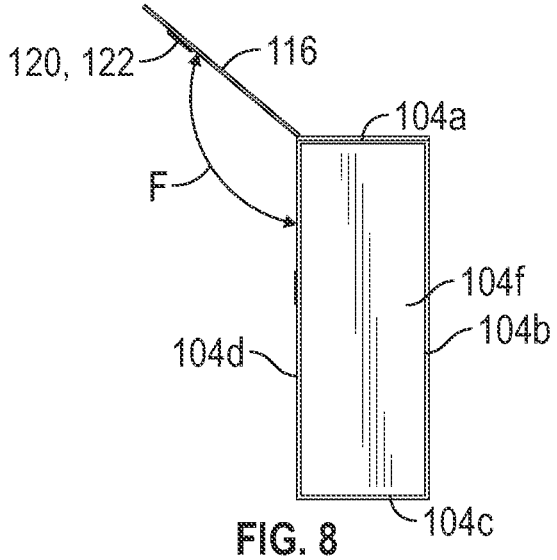
FIG. 8 is a right side view of the product package of FIG. 2.
Figure 9:
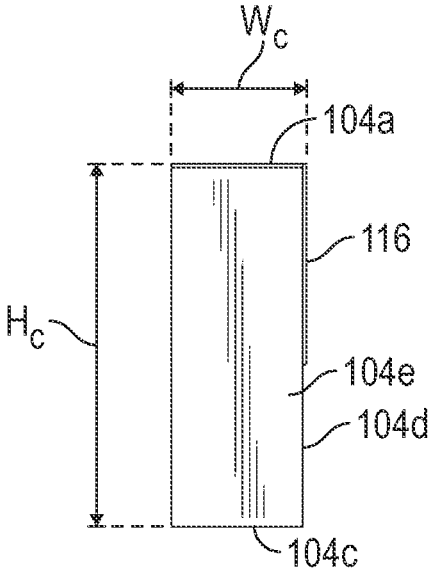
FIG. 9 is a left side view of the product package of FIG. 1.
Figure 10:
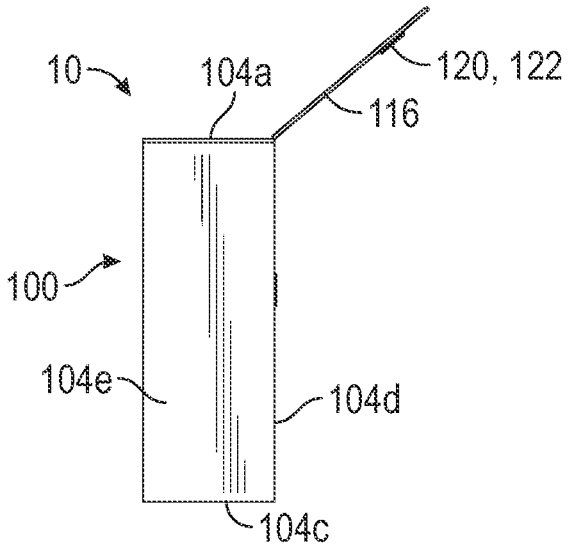
FIG. 10 is a left side view of the product package of FIG. 2.
Figure 11:
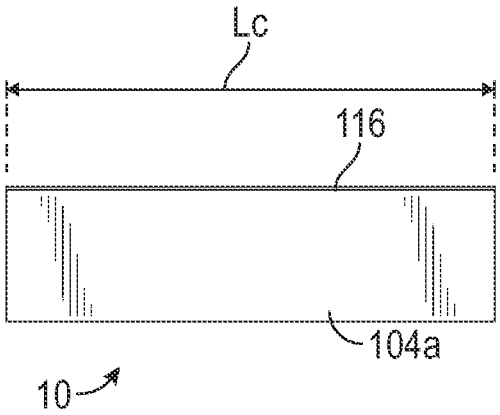
FIG. 11 is a top view of the product package of FIG. 1.
Figure 12:
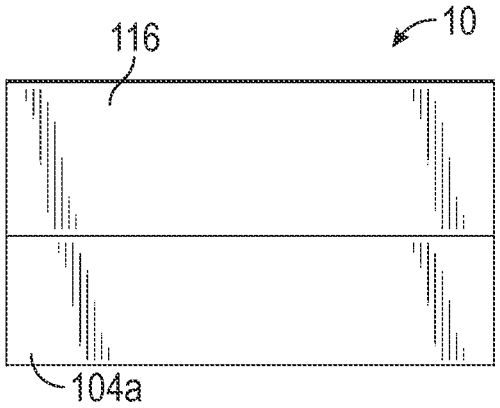
FIG. 12 is a top view of the product package of FIG. 2.
Figure 13:
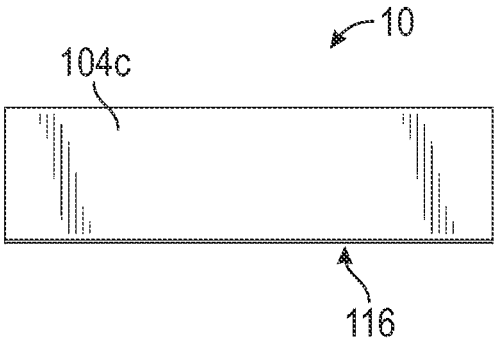
FIG. 13 is a bottom view of the product package of FIG. 1.
Figure 14:
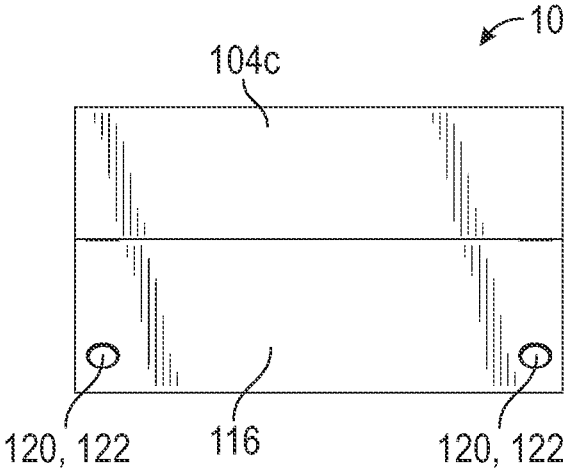
FIG. 14 is a bottom view of the product package of FIG. 2.

While the invention will be described in connection with the preferred embodiments shown herein, it will be understood that it is not intended to limit the invention to those embodiments. On the contrary, it is intended to cover all alternatives, modifications, and equivalents, as may be included within the spirit and scope of the invention as defined by the appended claims.

DETAILED DESCRIPTION

While this disclosure includes a number of details and implementations in many different forms, there is shown in the drawings and will herein be described in detail particular implementations with the understanding that the present disclosure is to be considered as an exemplification of the principles of the disclosed methods and systems, and is not intended to limit the broad aspects of the disclosed concepts to the implementations illustrated.

As shown in the Figures and explained below, an inventive product package or packaging 10 is described herein. The product package 10 has a "product reveal design," wherein: (i) the product(s) 15 is obscured from a potential buyer's view when the product package 10 is in a closed position and (ii) the product(s) 15 becomes visible to the potential buyer when an extent of the product package 10 is in a partially opened position. Once the product(s) 15 becomes visible to the potential buyer, an illumination assembly 300 illuminates the product(s) 15. This selective illumination of the product(s) 15 permits: (i) the illumination assembly 300 to be battery powered, (ii) highlights features and attributes of the product(s) 15 in order to attract and keep the potential buyer's attention, and (iii) makes it easier to see the product(s) 15 within the product package 10, which helps prevent potential buyers from removing the product(s) 15 from the package 10 thereby reducing the chance that the product(s) 15 is inadvertently damaged. These features considerably improve the value and utility of the package 10 while maintaining the appeal of the product(s) 15 therein, as well as the likelihood that they will be purchased by the buyer. Other features and benefits become evident to one of skill in the art based on the below disclosure and the associated Figures.

FIGS. 1-22B show a first embodiment of the product package 10. The product package 10 is configured to: (i) allow for efficient shipment 15, (ii) protect the product 15 from potential buyer's, (iii) protect a potential buyer's from the product 15, (iv) obscure the view of the product 15, when the package 10 is in a closed position or ready to ship state, and (v) exposes the product 15, when the package 10 is in a partially opened or display state. As such, the product package 10 includes: (i) a housing 100, (ii) a support assembly 200, (iii) illumination assembly 300. Each of these components and assemblies will be discussed in greater detail below.

Figure 15:
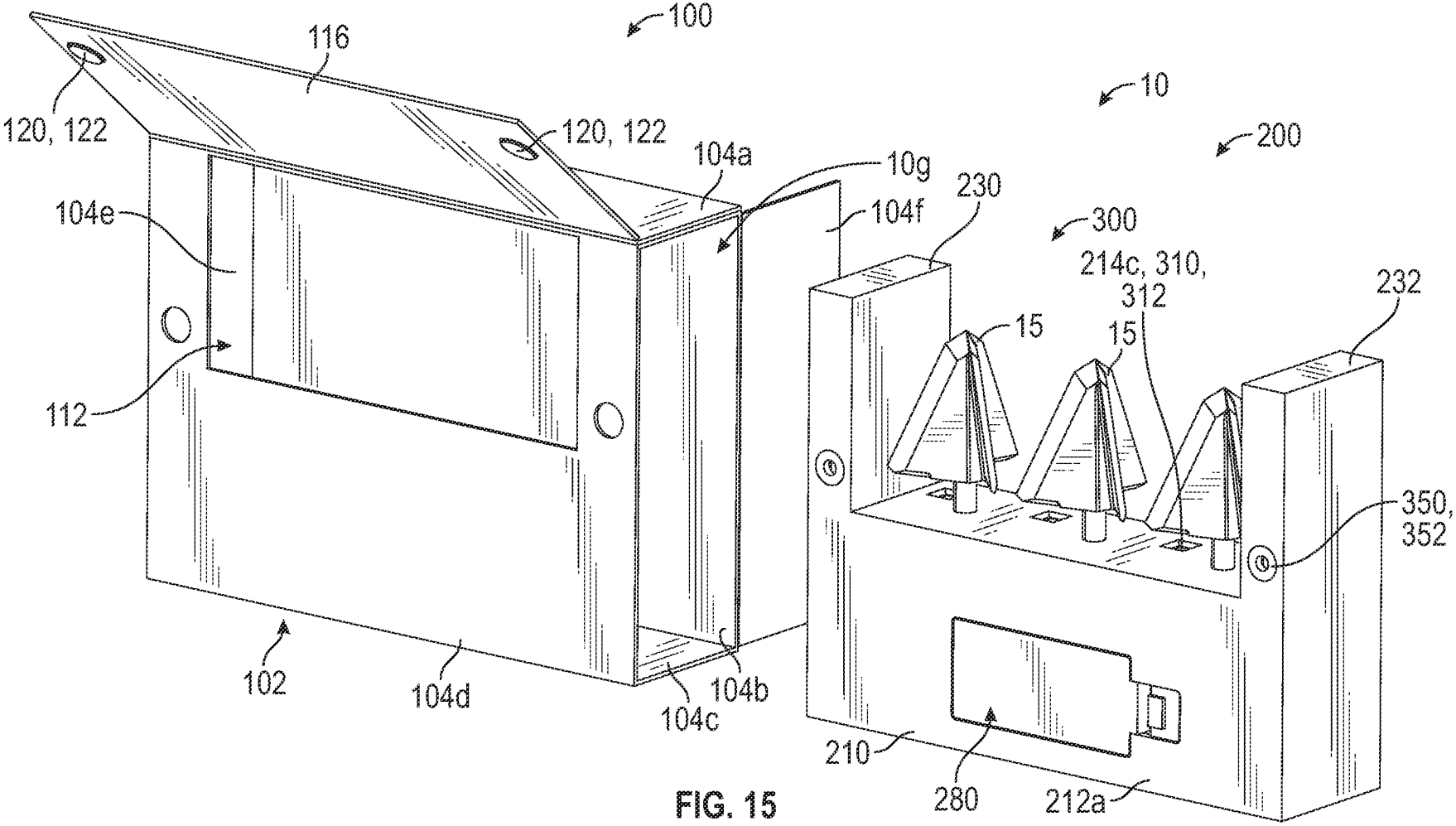
FIG. 15 is a exploded view of the product package of FIG. 1, wherein the support assembly and the products have been removed from a housing of the package to arrive at a fully open position.
Figure 16:
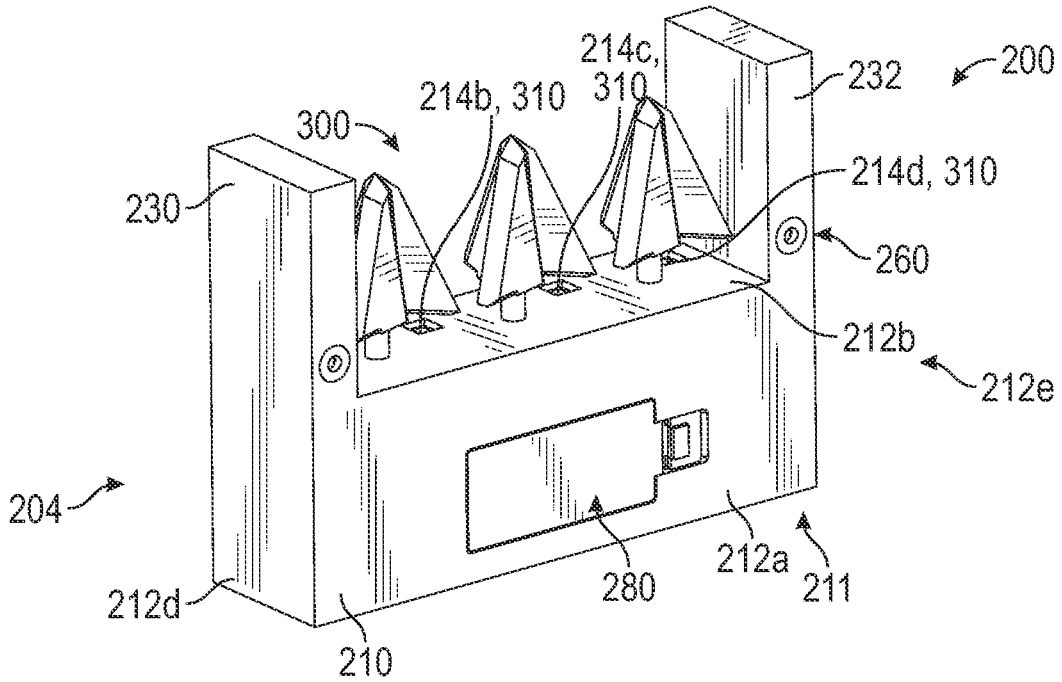
FIG. 16 is a perspective view of the support assembly of FIG. 15.
Figure 17:
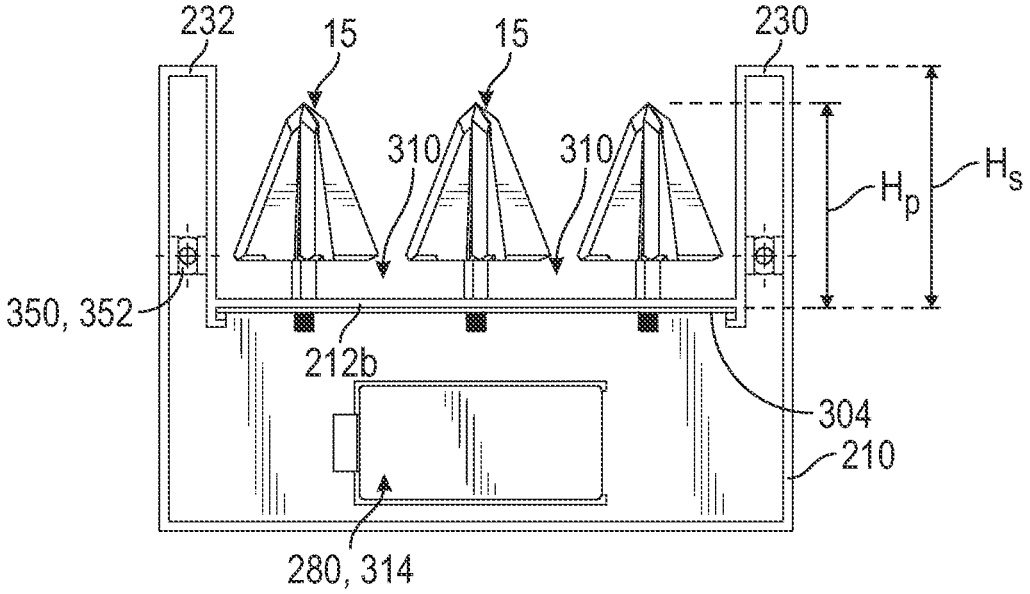
FIG. 17 is a rear view of the support assembly of FIG. 15.
Figure 18:
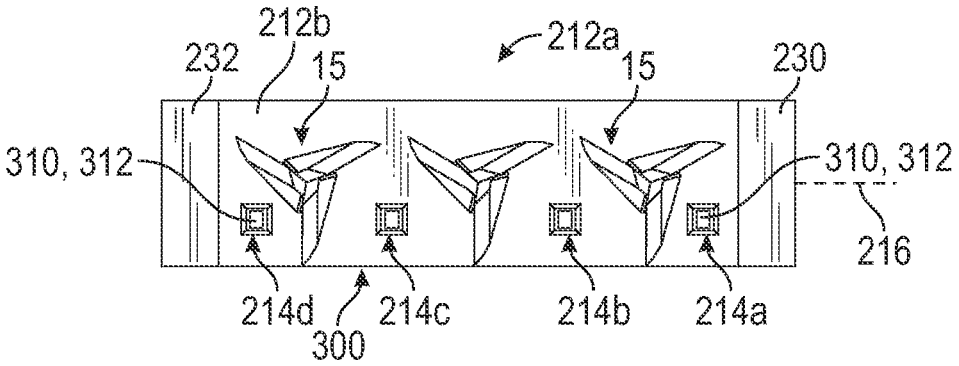
FIG. 18 is a top view of the support assembly of FIG. 15.
Figure 19A:
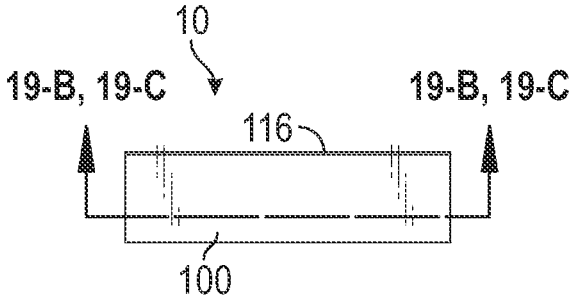
FIG. 19A is a top view of the product package of FIG. 1.
Figure 19B:
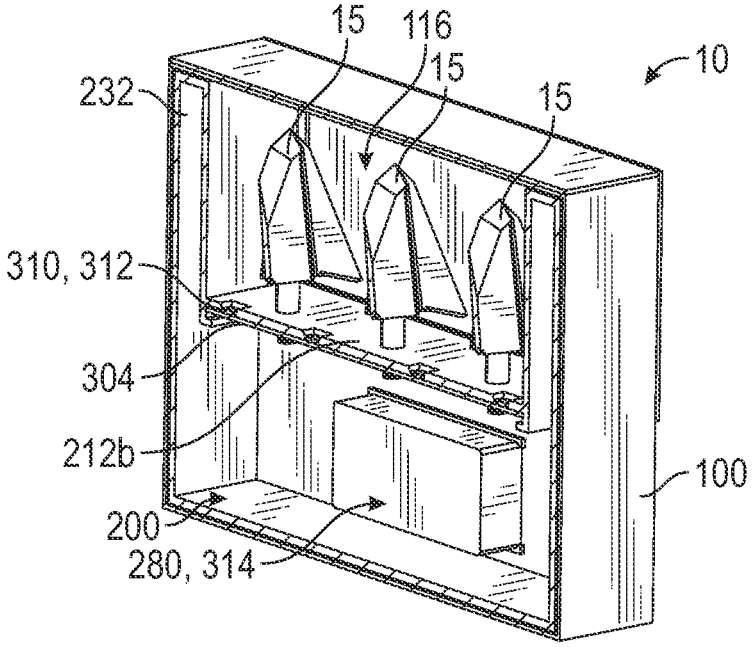
FIG. 19B is a cross-sectional perspective view of the product package of FIG. 19A taken along line 19B-19B.
Figure 19C:
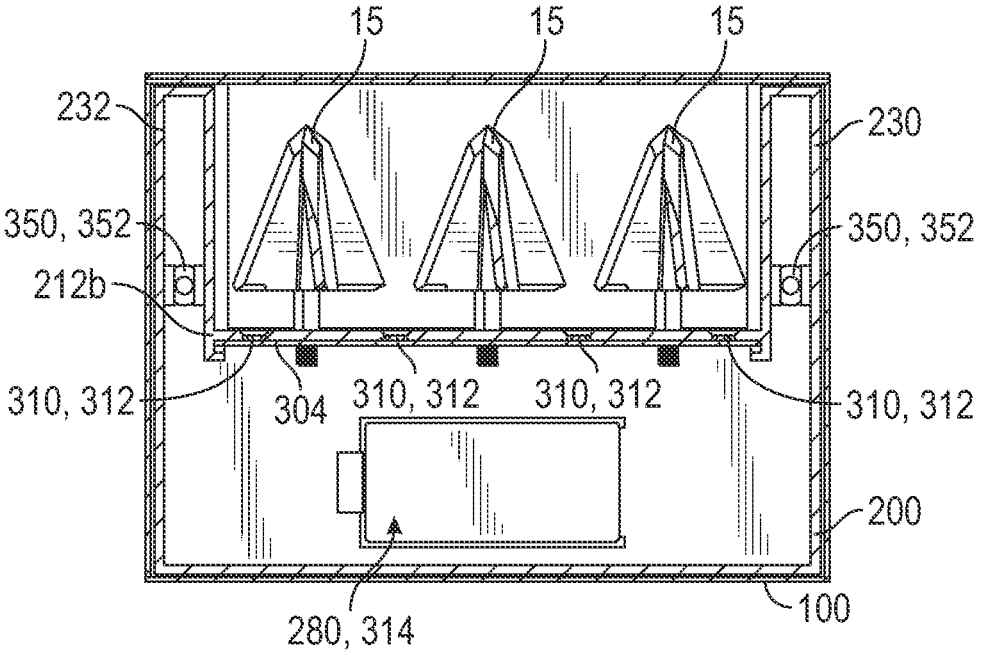
FIG. 19C is a cross-sectional rear view of the product package of FIG. 19A taken along line 19C-19C.
Figure 20:
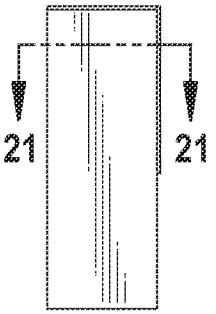
FIG. 20 is a left side view of the product package of FIG. 1.

The product package 10 has three different positions wherein: (i) the first or closed position is shown in FIGS. 1, 3, 5, 7, 9, 11, 13 wherein the package 10 is in a ready-to-ship configuration, (ii) the second or partially open position is shown in FIGS. 2, 4, 6, 8, 10, 12, and 14 wherein the package 10 is in a display configuration where the products 15 are visible through the package 10, and (iii) the third or fully open position is shown in FIG. 15 wherein the package 10 is in an accessible configuration where the products 15 and the support assembly 200 are removed from the package 10 to allow for further inspection and/or usage of the products 15. In the closed position, the illumination assembly 300 is off and the product 15 is not illuminated, which is appropriate given that the package 10 can be shipped from the manufacturer and distributed to retailers, distributors or customers in the closed position. In the partially opened and fully opened states, the illumination assembly 300 is on and the product 15 is illuminated. In other words, the illumination assembly 300 is in the off position or unilluminated state in FIGS. 1, 3, 5, 7, 9, 11, 13 and is on position or illuminated state in FIGS. 2, 4, 6, 8, 10, 12, and 14-15.

The product packaging 10 is configured to be a one-time use package and is not designed to allow users, customers, or buyers to insert different items within the packaging 10 subsequent to the original purchase of the product package 10. As such, the product packaging 10 may be formed from materials that are not intended to be used multiple times or from materials that are considered to be disposable (e.g., the housing 100 may be formed from a heavy-duty paper product and the support assembly 200 may be formed from plastic). The one-time use design of this packaging 10 is an advantage over the conventional packaging because the packaging 10 can be designed to highlight and illuminate a single product 15 (e.g., unique configuration of the illumination assembly 300 in comparison to the product 15) and does not have to be made in a manner that is durable enough to withstand use over multiple years, which reduces costs to manufacture the packaging 10 and the shipping weight of the packaging 10.

The housing 100 includes: (i) an arrangement 102 of walls 104*a*-104*f* that form a container 108, (ii) a display window 112 that is formed in at least one of the walls 104*a*-104*f*, (iii) a product concealing segment or flap 116, and (iv) a trigger means 120 that is designed to selectively activate or deactivate the illumination assembly 300. The arrangement 102 of walls 104*a*-104*f* are positioned such that they form a rectangular prism, wherein the width We is the smallest measurement, the length $L_C$ is the longest measurement, and the height $H_C$ is between the measurements for the width and length (see FIGS. 9 and 11). It should be understood that the arrangement 102 of walls 104*a*-104*f* may include more or less walls 104*a*-104*f* and be configured such that the housing 100 has a different overall shape. For example, the housing 100 may have any one of the following overall shapes including: a triangular prism, a cylinder, a cube, a pentagonal prism, a hexagonal prism, octagonal prism, sphere, a cone, a tetrahedron, a cuboid, a dodecahedron, an icosahedron, a torus, an octahedron, or an ellipsoid.

The display window 112 has a rectangular shape, is an opening formed in the front wall 104*d* of the housing 100, and includes a transparent cover 112*a* that extends across the entire opening of the display window 112. The display window 112 is positioned within the upper half 113*a* of the front wall 104*d* and preferably in a manner that places the top edge of the display window 112 adjacent to the top wall 104*a* of the housing 100. By positioning the window 112 in the upper half 113*a* of the front wall 104, the lower half 113*b* of the front wall 112 can obscure the lower extent of the support assembly 200. This is beneficial because this lower extent of the support assembly that contains the power source compartment 280 is desirably obscured from the potential buyer's view. The height $H_W$ of the display window 112 is greater than the height $H_P$ of the product 15 that extends above an extent of the support assembly 200. This configuration ensures that the potential buyer can see the entire relevant extent of the product 15, when the package 10 is in the partially open or displays state. It should be understood that: (i) the transparent cover 112*a* may be clear or colored and may be utilized or excluded from the packaging 10, (ii) the shape of the display window 112 may take any shape, including the shapes listed above, and (iii) the positioning of the display window 112 may be changed such that it is in the middle, lower half 113*b*, or to one side of the housing 100.

The concealing flap 116 is movable and hingedly connected to the top wall 104*a* of the housing 100. The concealing flap 116 is designed to overlie the display window 112 to obscure the product from view and protected during shipment. As such, the concealing flap 116 is larger (e.g., has a greater length and width) than the display window 112, but has an overall shape (e.g., rectangular) similar to the display window 112. In certain embodiments, the concealing flap 116 may contain a hologram on the outermost extent. This hologram may display multiple different images depending on the angle of the concealing flap 116. For example, in the closed position, the hologram may display a deer and the phrase "failure is not an option." As the potential buyer moves the concealing flap 116 from the closed position to the partially open position, the hologram may display an arrow striking the deer and the phrase "field point accuracy." Other holograms, including holograms with more or fewer images (e.g., 1 to 100) are contemplated by this disclosure.

The product conceal flap 116 is movable by the potential buyer and said movement alters the state or configuration of the package 10. As discussed above and shown in FIGS. 1, 3, 5, 7, 9, 11, 13, the product package 10 is in the closed position because the concealing flap 116 is lowered or substantially parallel with an extent of the front wall 104*d*.

Additionally, as shown in FIGS. 2, 4, 6, 8, 10, 12, and 14, the product package 10 is in the partially opened state because the concealing flap 116 is not lowered nor is it substantially parallel with an extent of the front wall 104*d*. To move the concealing flap 116 from the lowered position to a non-lowered position, the potential buyers will apply a force on the concealing flap 116 that has a curvilinear component (see FIG. 8). Typically, in this partially opened state, the concealing flap 116 forms at least a 90° angle with the front wall 104*d* and preferably 120° angle with the front wall 104*d*. This large obtuse angle allows the potential buyer to view the product 15 through the display window 112. However, small or larger angles between the concealing flap 116 and the front wall 104*d* may be utilized to enable viewing of the product 15.

As described above and shown in FIGS. 1-22B, the concealing flap 116 flips up to reveal the display window 112 and in turn the product 15. It should be understood that the concealing flap 116 could be fixed to the housing 100 in a different manner or could function in a different way. For example, the concealing flap 116 could slide down, such that it is positioned against the lower half 113*b* of the front wall 112. This sliding movement will require different structures, such as channels for the concealing flap 116 to move across, within the scope of this disclosure. Alternatively, the concealing flap 116 could rotate (i.e., clockwise or counter-clockwise) in order to reveal the display window 112. Again, like the sliding movement, this rotational movement will require different structures, a fixed point that the concealing flap 116 can rotate around within the scope of this disclosure. Moreover, the concealing flap 116 may simply be pulled away from or removed from the housing 100 by a force that is substantially parallel with the top wall 104*a* of the housing.

In an alternative embodiment, the display window 112 and the concealing flap 116 may have a different configuration. For example, the display window 112 may extend along a portion of two different walls 104*d*, 104*a* of the housing and the concealing flap 116 may have multiple sections (e.g., a first section that covers the display window 112 that extends along wall 140*d* and second section that covers the display window 112 that extends along wall 140*a*). In this embodiment, the potential buyer may apply a first force that may have a first curvilinear component to move/flip the first section of the concealing flap 116 away from the front wall 104*d* and a second force that may have a second curvilinear component to move/flip the second section the concealing flap 116 away from the top wall 104*a*. Further embodiments with more display windows 112 (e.g., between 3 and 40) and more concealing flaps 116 (e.g., between 3 and 40) is contemplated by this disclosure. Additionally, complex movements (e.g., where multiple segments move in different directions) of these flaps 116 are also contemplated.

As will be discussed in greater detail below, the trigger means 120 is designed to selectively activate or deactivate the illumination assembly 300 depending on the state of the package 10. The trigger means 120 in this configuration is a magnet 122 that interacts with switching means 350, which is a metal disk 352, coupled to the internal support assembly 200. In the closed position, the trigger means 120 or magnet 122 is releasably coupled to the switching means 350 or metal disk 352 and the illumination assembly 300 is off. This in turn, releasably couples the concealing flap 116 to an extent of the front wall 104*d* of the housing 100. This design aids in protecting the product during shipment. Once the trigger means 120 or magnet 122 is uncoupled from the switching means 350 or metal disk 352, the package 10 is in the partially opened state and the illumination assembly 300 is on. In summary, the position of the trigger means 120 changes the state of the packaging 10 and whether the illumination assembly 300 is in the on or off position. It should be understood that in other embodiments, the trigger means 120 may be: (i) a hook and loop fastener, (ii) a metal contact that is slidably or rotatably engaged with the switching means 350, or (iii) a press fit structure.

The support assembly 200 is best shown in FIGS. 15-22B. The support assembly 200 is removably positioned within the container 208, supports and positions the product 15 within the display window 112, is a free-standing component that self-supports the product 15 in the fully open position, and allows the illumination assembly 300 to desirably illuminate the product 15. The support structure 200 is not visible through the display window 112 in the partially open position when the package is viewed on-center (see FIG. 4) and a major extent of the support assembly 200 is not visible through the display window 112 in the partially open position. The support assembly 200 includes: (i) a main body 204, (ii) a recess 260 that is configured to receive the switching means 350, and (iii) a power source compartment 280. The main body 204 is comprised of: (i) a base structure 210 and (ii) two support structures 230, 232 that extend upward in a substantially vertical fashion from the lower rectangular structure 210. The base structure 210 is substantially rectangular and includes an arrangement 211 of walls 212*a*-212*e*. When the support structure 200 is contained within the housing 100: (i) the bottom wall 212*c* is designed to be positioned adjacent to the bottom wall 104*c* of the housing 100, (ii) the front wall 212*a* is designed to be positioned adjacent to the lower half 113*b* of the front wall 104*d* of the housing 100, (iii) the left side wall 212*d* is designed to be positioned adjacent to the left side wall 104*e* of the housing 100, and (iv) the right side wall 212*e* is designed to be positioned adjacent to the right side wall 104*f* of the housing 100.

The top wall 212*b* is a horizontal reflecting surface and is designed to be positioned adjacent to the product 15 and facilitate illumination of the product 15 in the partially open position. In the embodiment shown in FIGS. 1-22B, the top wall 212*b* includes threaded openings therethrough to receive a threaded extent of the product 15. In other embodiments, the product 15 may be coupled or positioned adjacent to the top wall 212*b* in a different manner. For example, the product 15 may be coupled to the top wall using a twist tie, zip tie or cable tie, adhesive, hook and loop, or any other coupling method. The top wall 212*b* also includes a plurality of illumination apertures 214*a*-214*d* that are: (i) positioned behind the mid-line 214 of the top wall 212 (i.e., away from the front wall 212*a*) and (ii) behind an extent of the product 15. By placing the illumination apertures 214*a*-214*d* behind the mid-line 216 of the top wall 212, there is a larger distance between a front extent of the illumination apertures 214*a*-214*d* and the forward most extent of the top wall 212*b* then the distance between a rear extent of the illumination apertures 214*a*-214*d* and the rearmost extent of the top wall 212*b*. This configuration helps ensure that the product 15 is backlit and helps avoid light from directly exiting from the illumination assembly into a potential buyer's eyes. In addition to being positioned behind the product 15, the illumination apertures 214*a*-214*d* are interspersed or arranged between the products 15. In other words and looking at the product from left to right, there is an illumination aperture 214*a*, a product 15, an illumination aperture 214*b*, a product 15, illumination aperture 214*c*, a product 15, illumination aperture 214*d*. This placement of illumination apertures 214*a*-214*d* is a benefit of the conventional packaging designs because it backlights the products 15 and highlights the product features (e.g., angled blades).

The two support structures 230, 232 that extend upward from the lower rectangular structure 210 and are positioned on opposite ends of the lower rectangular structure 210. The support structures 230, 232 include at least one vertical reflecting surface located adjacent to the product that facilitates illumination of the product in the partially open position and have a height Hs that is larger than the height $H_P$ of the product 15 that extends above the top wall 212*b* of the lower rectangular structure 210. This positional relationship and the height enables the two support structures 230, 232 to help protect the product 15 from becoming crushed or damaged during the shipping and handling process. Preferably, the two support structures 230, 232 are molded into and integrally formed as a part of the lower rectangular structure 210. As shown in the Figures, there is no structure connecting the two support structures 230, 232 along with the uppermost extent of these structures 230, 232. In this embodiment, it was determined to be unnecessary to include this additional structure due to the size, weight, and type of product 15. However, in other embodiments, an additional structure may be positioned between the two support structures 230, 232 to form a support assembly 200 that fully surrounds the product 15.

In addition to protecting the product 15, the two support structures 230, 232 include the recess 260 that is configured to receive the switching means 350. This recess 260 positions the switching means 350 in a location that can effectively mate with the trigger means 120, when the packaging 10 is in the closed position. Additionally, it is desirable to place the switching means 350 in this location because: (i) placing it on the lower rectangular structure 210 would require a larger product conceal flap 116, (ii) placing it higher on the two support structures 230, 232 would require the potential buyer to open the product conceal flap 116 further in order to activate the internal illumination assembly 300, and (iii) it helps keep the product conceal flap 116 in the closed position during shipping and handling because a lower extent of the product conceal flap 116 is releasably coupled to the front wall 104*d* of the housing 100.

The power source compartment 280 is formed within the front wall 212*a* of the lower rectangular structure 210 and extends rearward from said front wall 212*a*. This power source compartment 280 is designed to receive at least one power source and position said power source under an extent of the product 15. As described below, the power source 314 may take many different shapes or forms and as such the compartment 280 may be changed to best support the power source. It should be understood that in other embodiments, the support assembly 200 may have different configurations or shapes. For example, if the housing 100 has one of the alternative shapes that is described above, then support assembly 200 may have a similar shape. Additionally, the main body 204, recesses 260, power source compartment 280 may have different configurations, positions, or shapes. For example, the power source compartment 280 may be omitted, as the power source 314 may be integrally formed with the printed circuit board 304 of the illumination assembly 300. Further, the lower rectangular structure 210 and two support structures 230, 232 may have different configurations, positions, or shapes. For example, two support structures 230, 232 may not have a vertical orientation and instead may extent upward from the lower rectangular structure 210 at an angle.

The illumination assembly 300 is coupled to the support assembly 200 and selectively illuminates the product 15. By directly coupling the illumination assembly 300 to the support assembly 200, the complexity of the housing 100 is reduced, the housing 100 can be less durable and lighter weight, and it is easier to manufacture the packaging 10. This provides a benefit over conventional packaging designs because it helps reduce manufacturing costs and shipping costs, which in turn aids in allowing the packaging 10 to be configured to be disposable or used only once for a single product. The illumination assembly 300 includes: (i) a printed circuit board (PCB) 304 that includes a plurality of light emitters (e.g., LEDs) 310 coupled thereto, (ii) a power source (e.g., batteries) 314, (iii) wires (not shown) that electrically couple the power source 314 to the PCB 304, (iv) switching means 350, and (iv) wires (not shown) that electrically couple the PCB 304 to the switching means 350. It should be understood that in alternative embodiments, the illumination assembly 300 may include additional components (e.g., additional PCBs, LEDs, switches, etc.) or fewer components (e.g., no PCB and instead of a single LED).

The PCB 304 is an elongated circuit board that includes the necessary circuit components (e.g., diodes, resistors, inductors) coupled thereto to effectively and properly illuminate the LEDs 310. The PCB 304 also acts as a support surface of the light emitters 310, which supports them and does not require the designer to include additional structures within the support assembly 200 to receive each individual LED 310. To this end, the light emitters 310 are light emitting diodes (LEDs) 312 and more particularly are surface-mounted LEDs. The light emitters 310 are arranged along the PCB 304 in a manner that they align with the illumination apertures 214*a*-214*d* to allow the light that is emitted from the LED 312 to illuminate the product 15.

Figure 21:
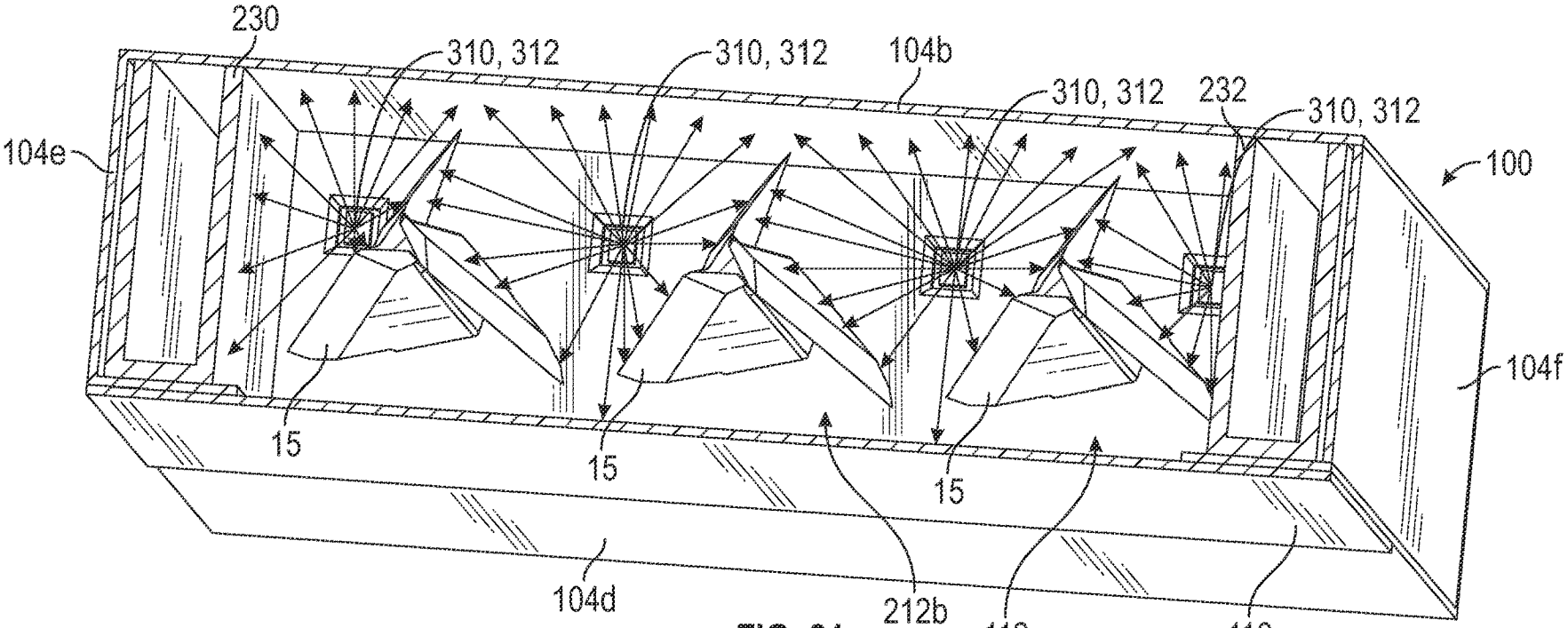
FIG. 21 is a cross-sectional perspective view of the product package of FIG. 20 taken along line 21-21 and showing ray traces emitted by the illumination assembly.
Figure 22A:
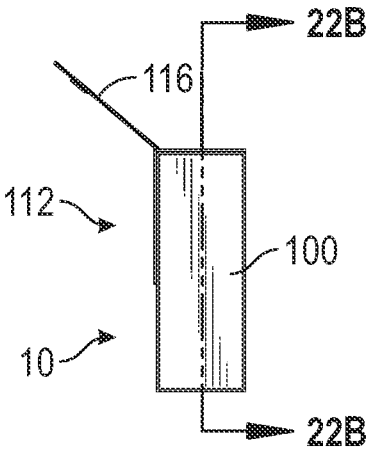
FIG. 22A is a right side view of the product package of FIG. 2.
Figure 22B:
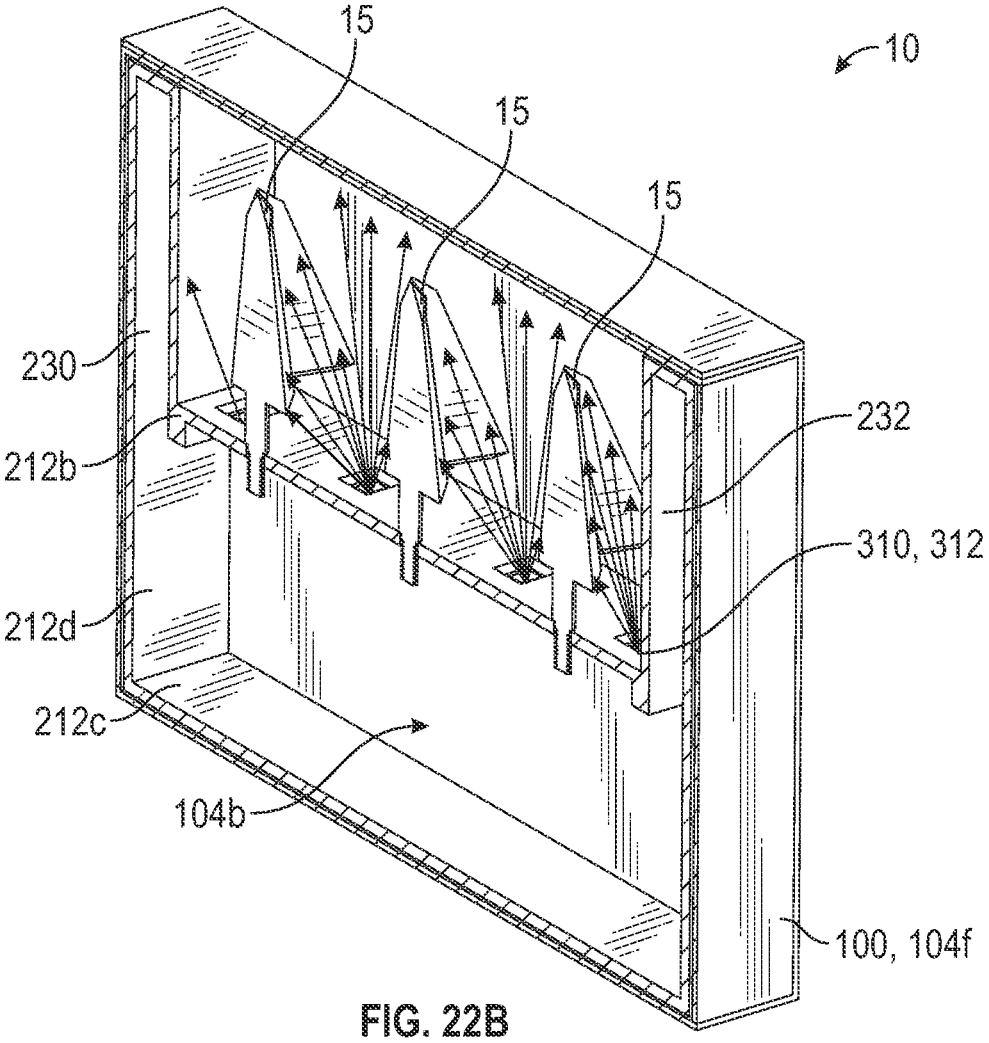
FIG. 22B is a cross-sectional perspective view of the product package of FIG. 22A taken along line 22B-22B and showing ray traces emitted by the illumination assembly.
Figure 23:
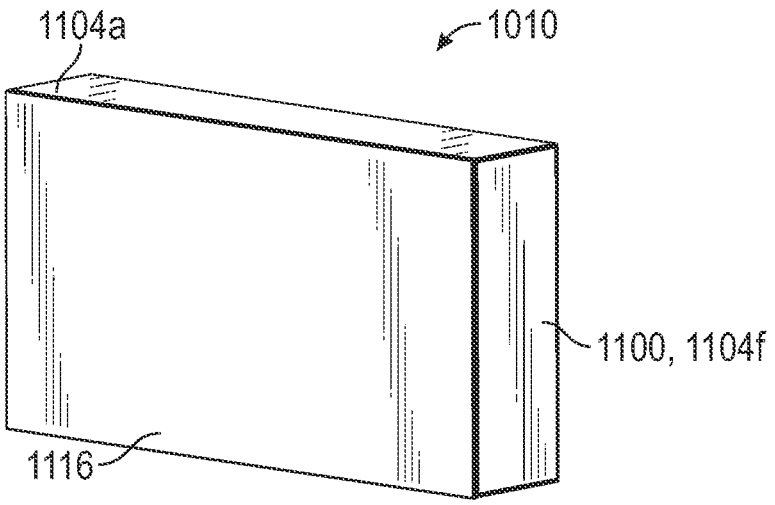
FIG. 23 is a perspective view of a second embodiment of a product package with an internal illumination assembly, the product package being in a closed position or ready to ship state.
Figure 24:
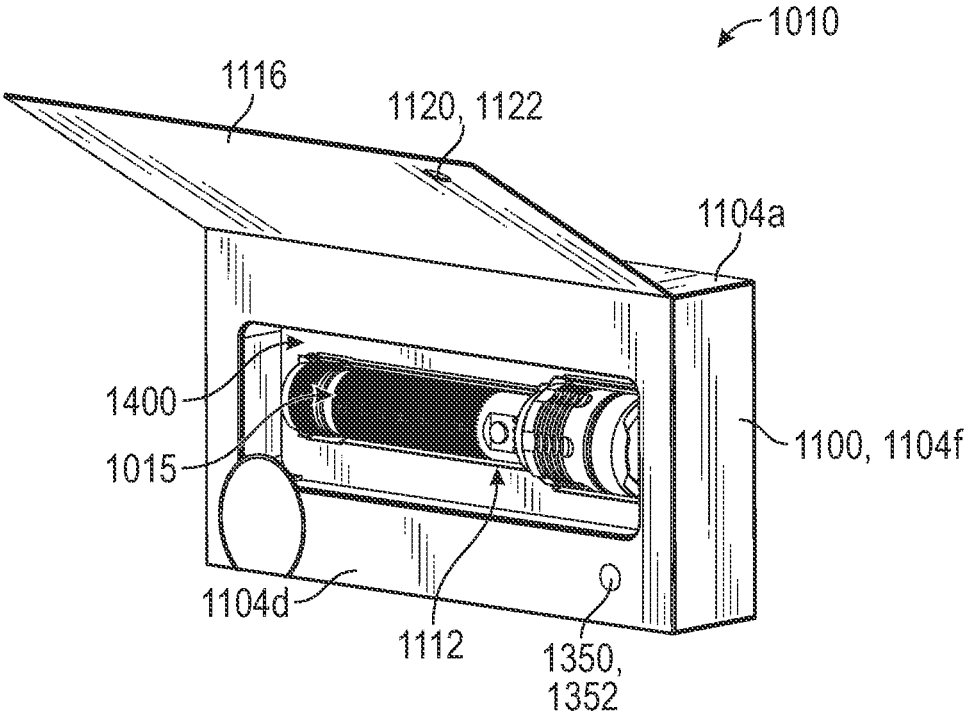
FIG. 24 is a perspective view of the product package of FIG. 23, wherein a flap segment of the product package is moved from the closed position to a partially open position in order to view the product residing within the housing of the package.
Figure 26:
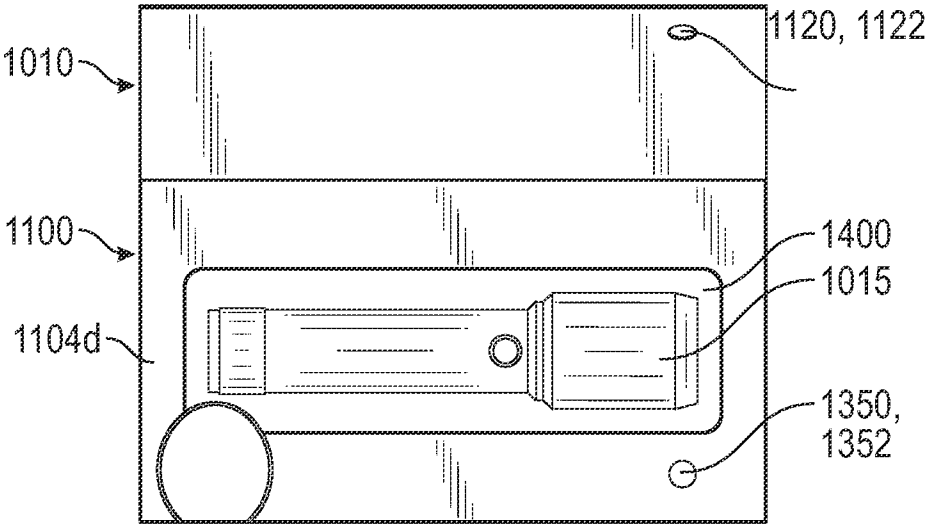
FIG. 26 is a front view of the product package of FIG. 24.
Figure 25:
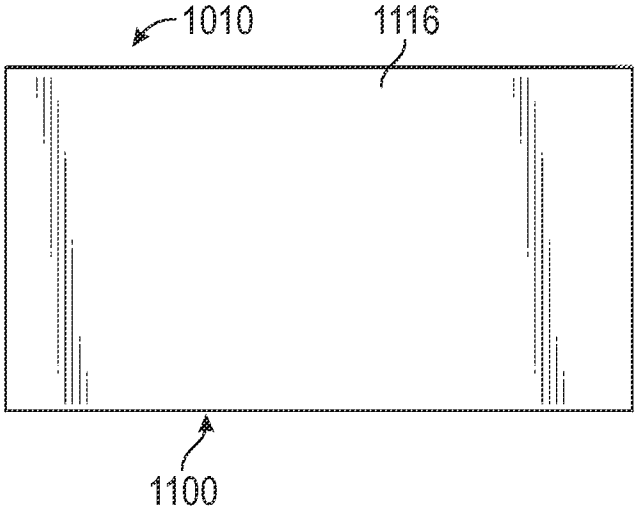
FIG. 25 is a front view of the product package of FIG. 23.
Figure 28:
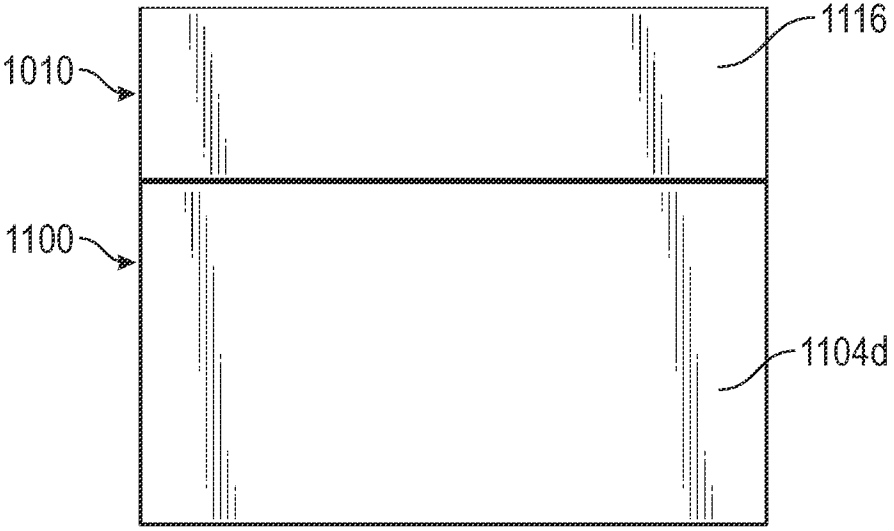
FIG. 28 is a rear view of the product package of FIG. 24.
Figure 27:
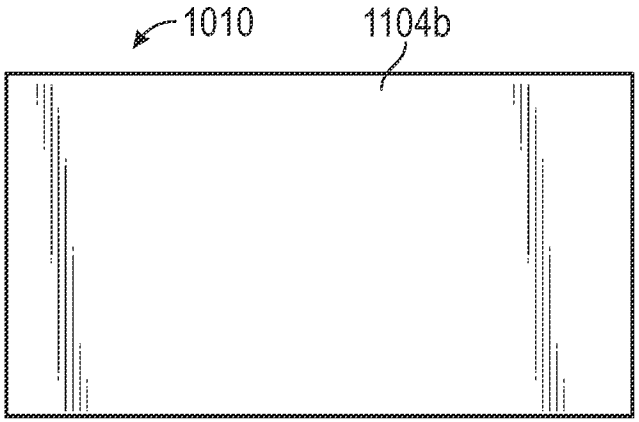
FIG. 27 is a rear view of the product package of FIG. 23.
Figure 29:
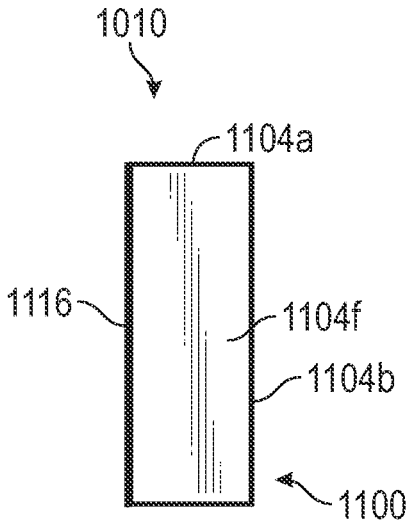
FIG. 29 is a right side view of the product package of FIG. 23.
Figure 30:
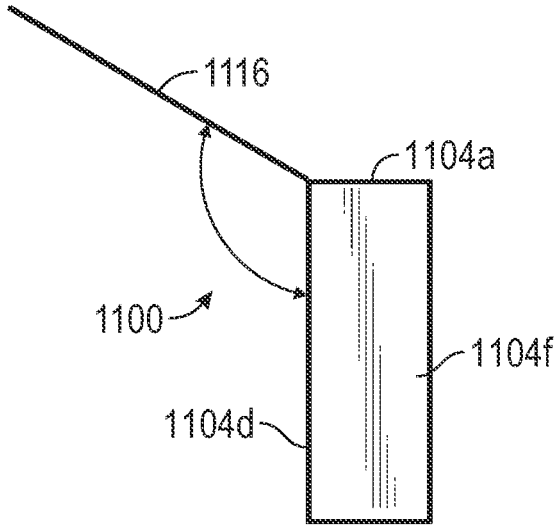
FIG. 30 is a right side view of the product package of FIG. 24.
Figure 31:
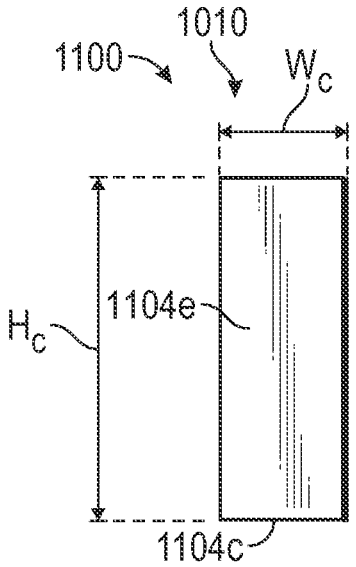
FIG. 31 is a left side view of the product package of FIG. 23.
Figure 32:
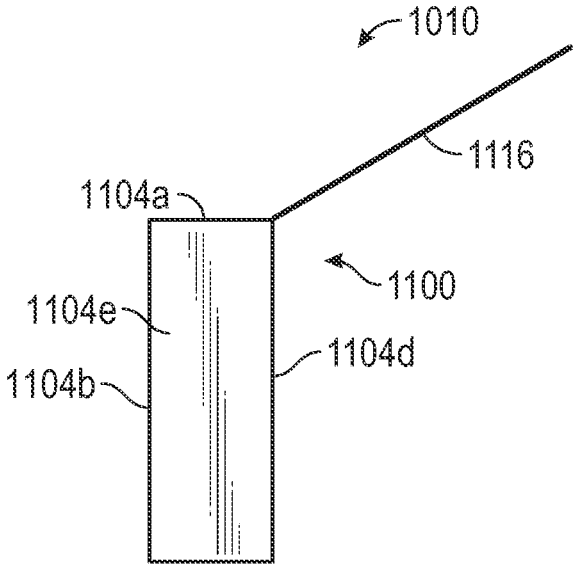
FIG. 32 is a left side view of the product package of FIG. 24.
Figure 33:
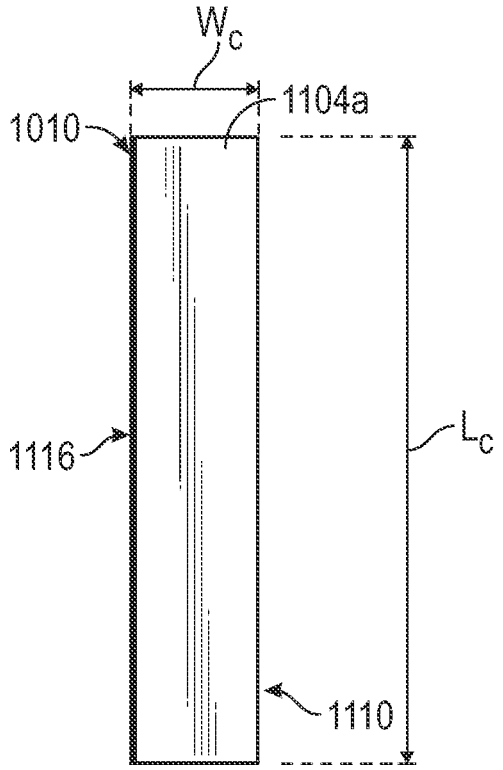
FIG. 33 is a top view of the product package of FIG. 23.
Figure 34:
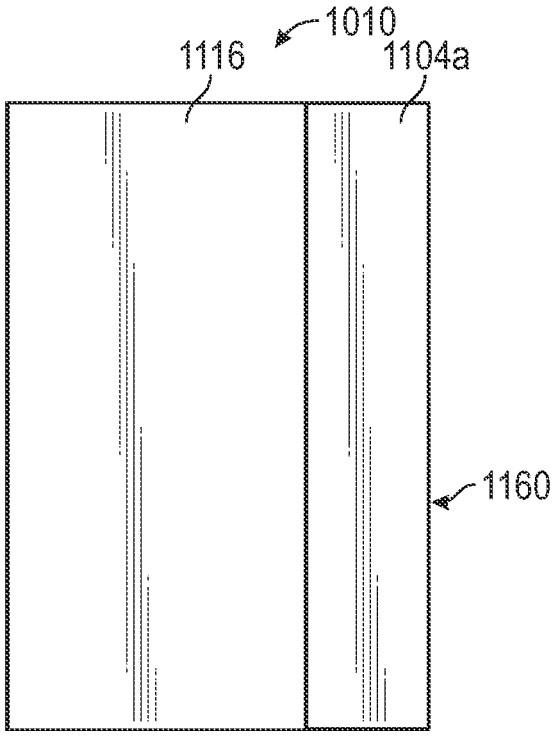
FIG. 34 is a top view of the product package of FIG. 24.
Figure 35:
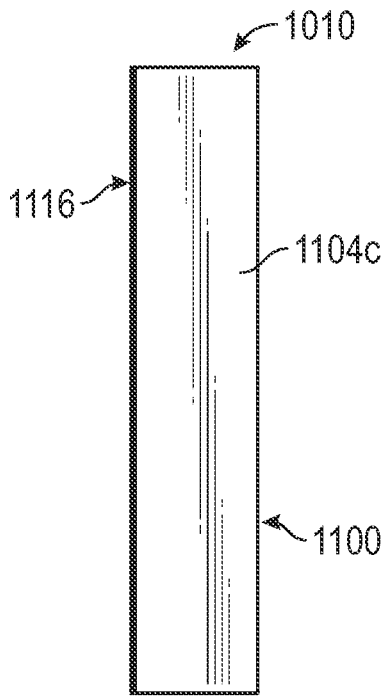
FIG. 35 is a bottom view of the product package of FIG. 23.
Figure 36:
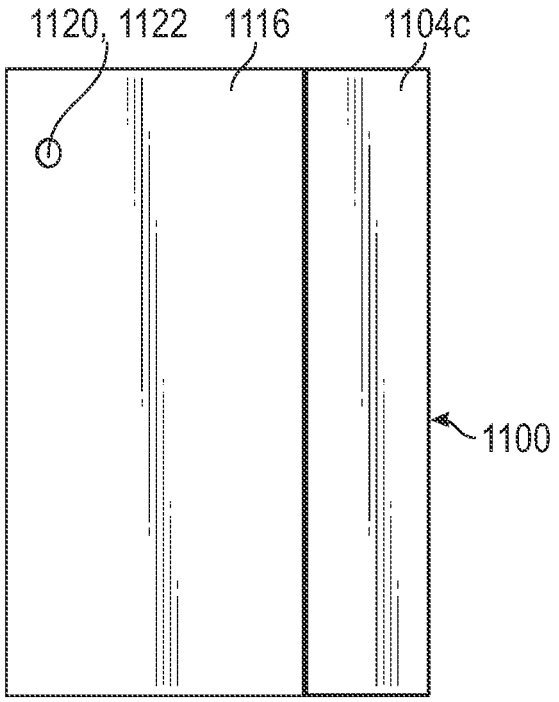
FIG. 36 is a bottom view of the product package of FIG. 24.
Figure 37:
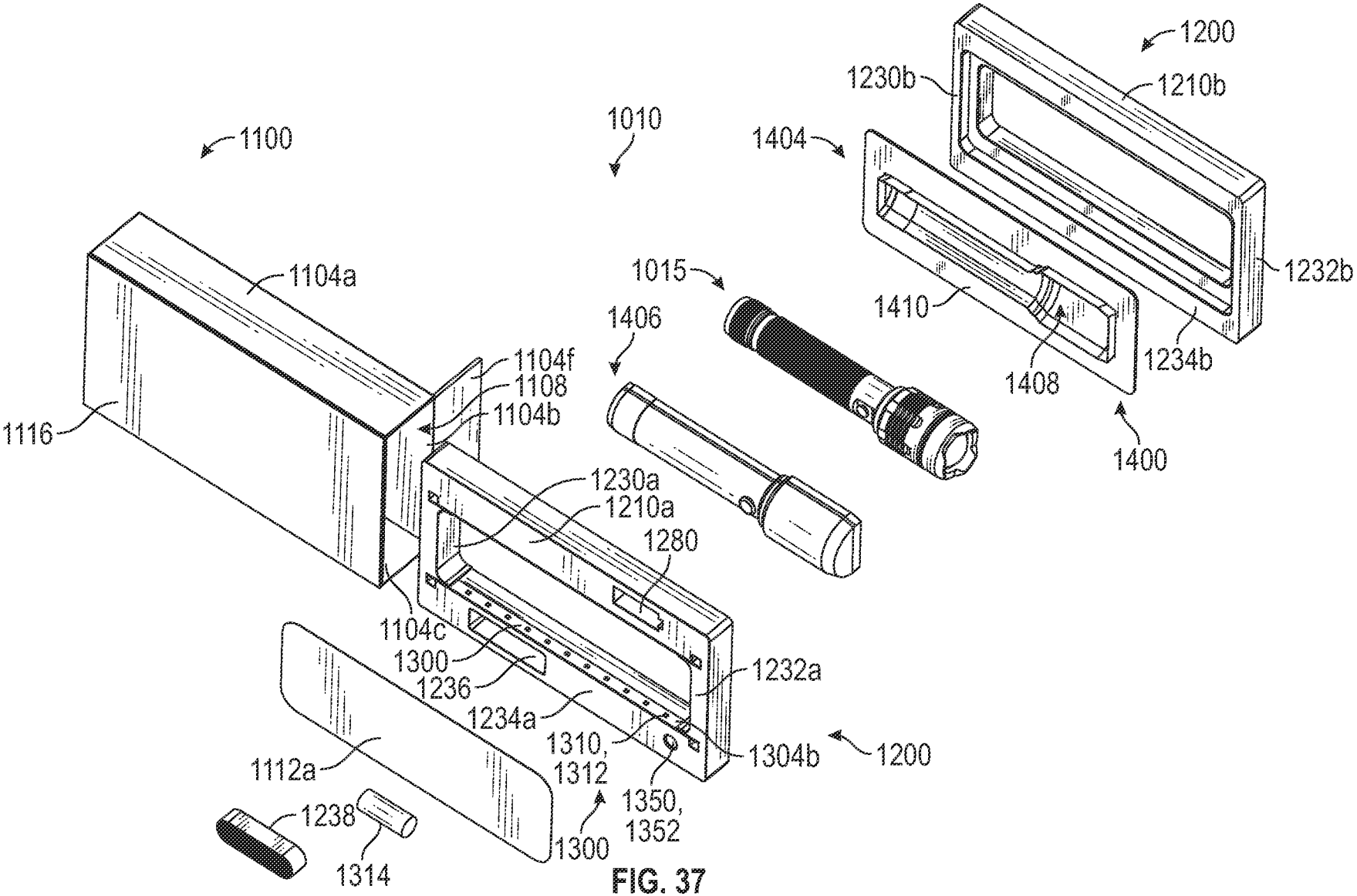
FIG. 37 is a first exploded view of the product package of FIG. 23, wherein the support assembly, product retainer, and product have been removed from the housing of the package.
Figure 38:
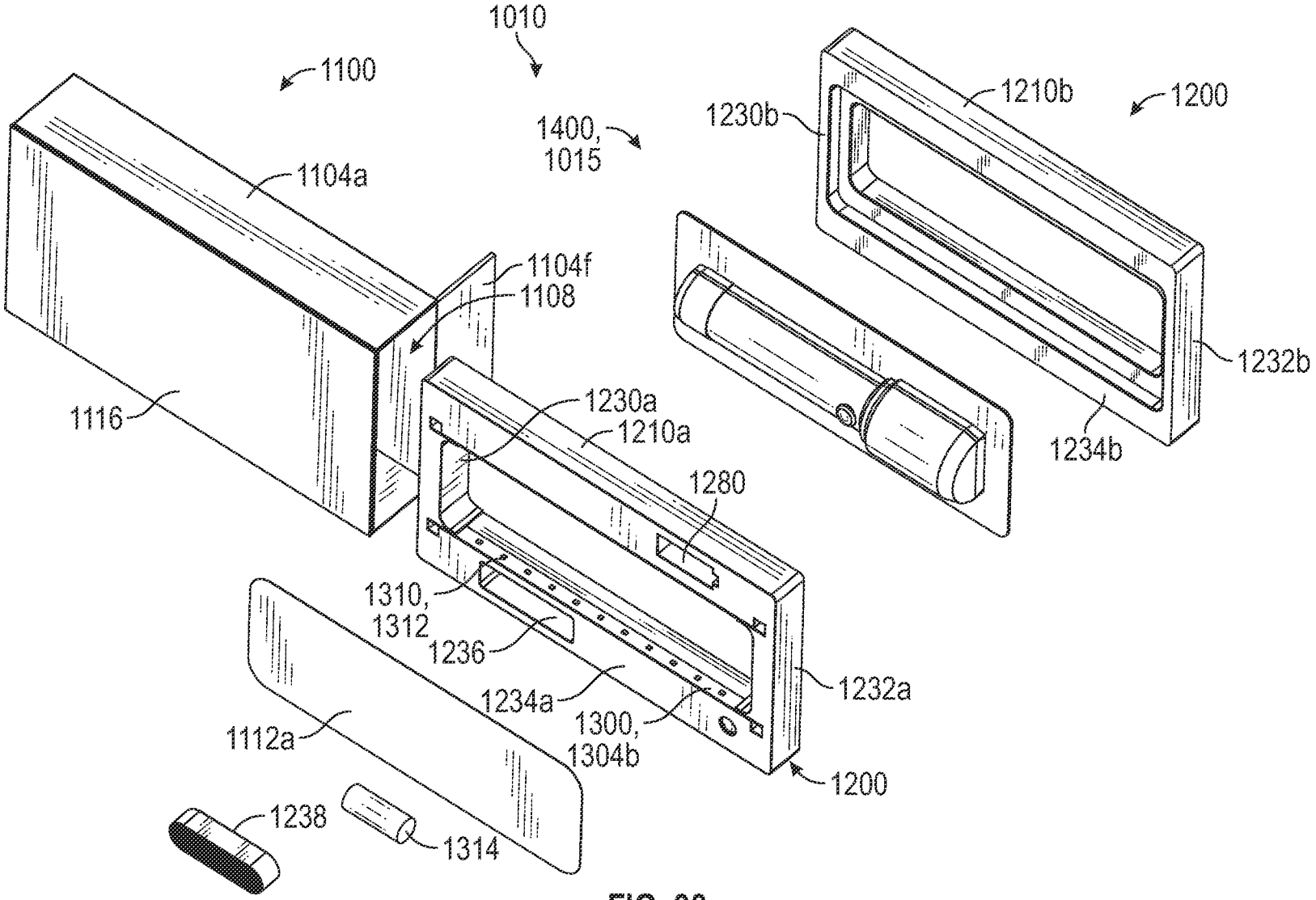
FIG. 38 is a second exploded view of the product package of FIG. 23, wherein the support assembly, product retainer, and product have been removed from the housing and the product has been positioned within the product retainer.
Figure 39:
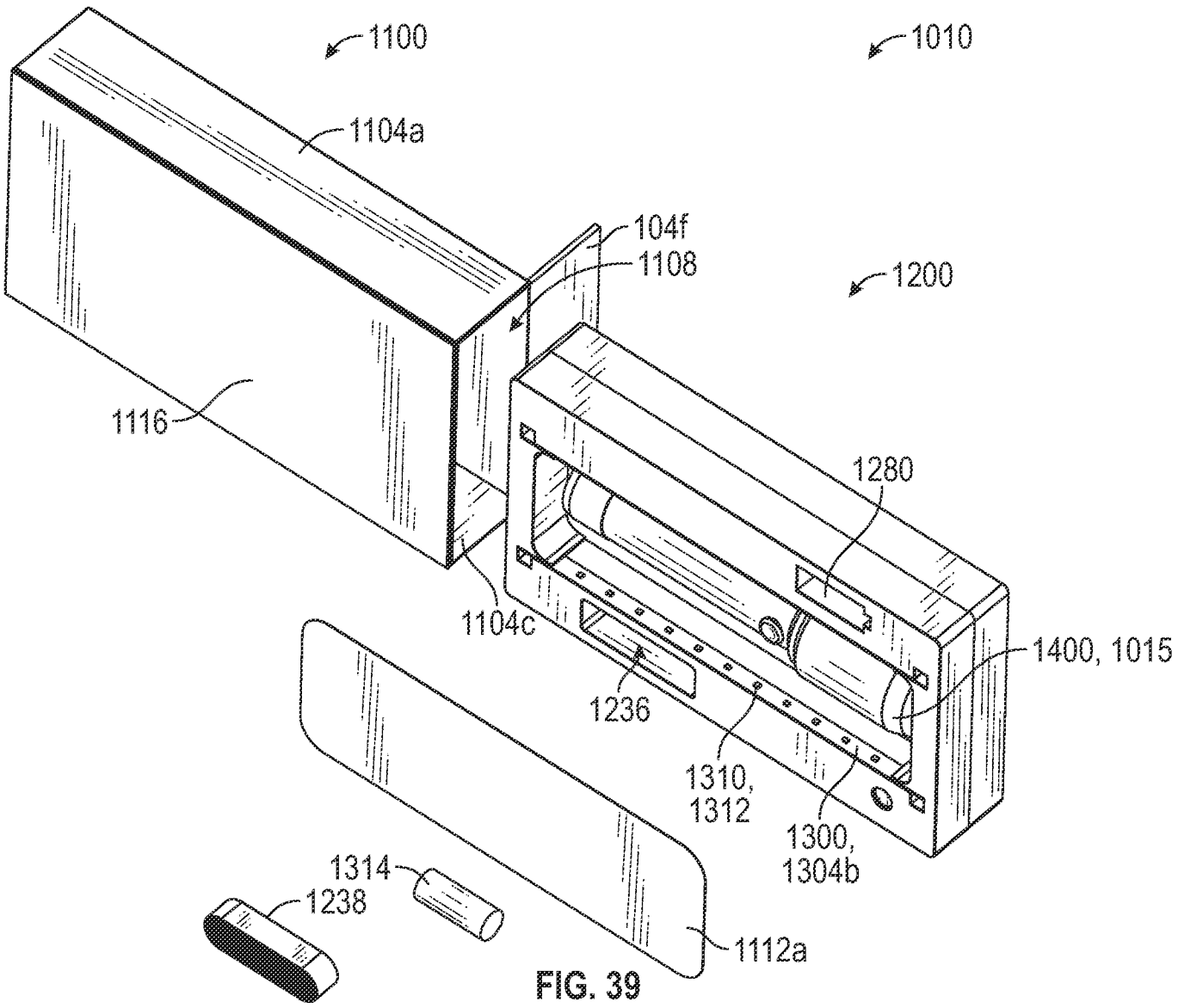
FIG. 39 is a third exploded view of the product package of FIG. 23, wherein the support assembly, product retainer, and product have been removed from the housing and the product retainer is coupled to the support assembly.
Figure 40:
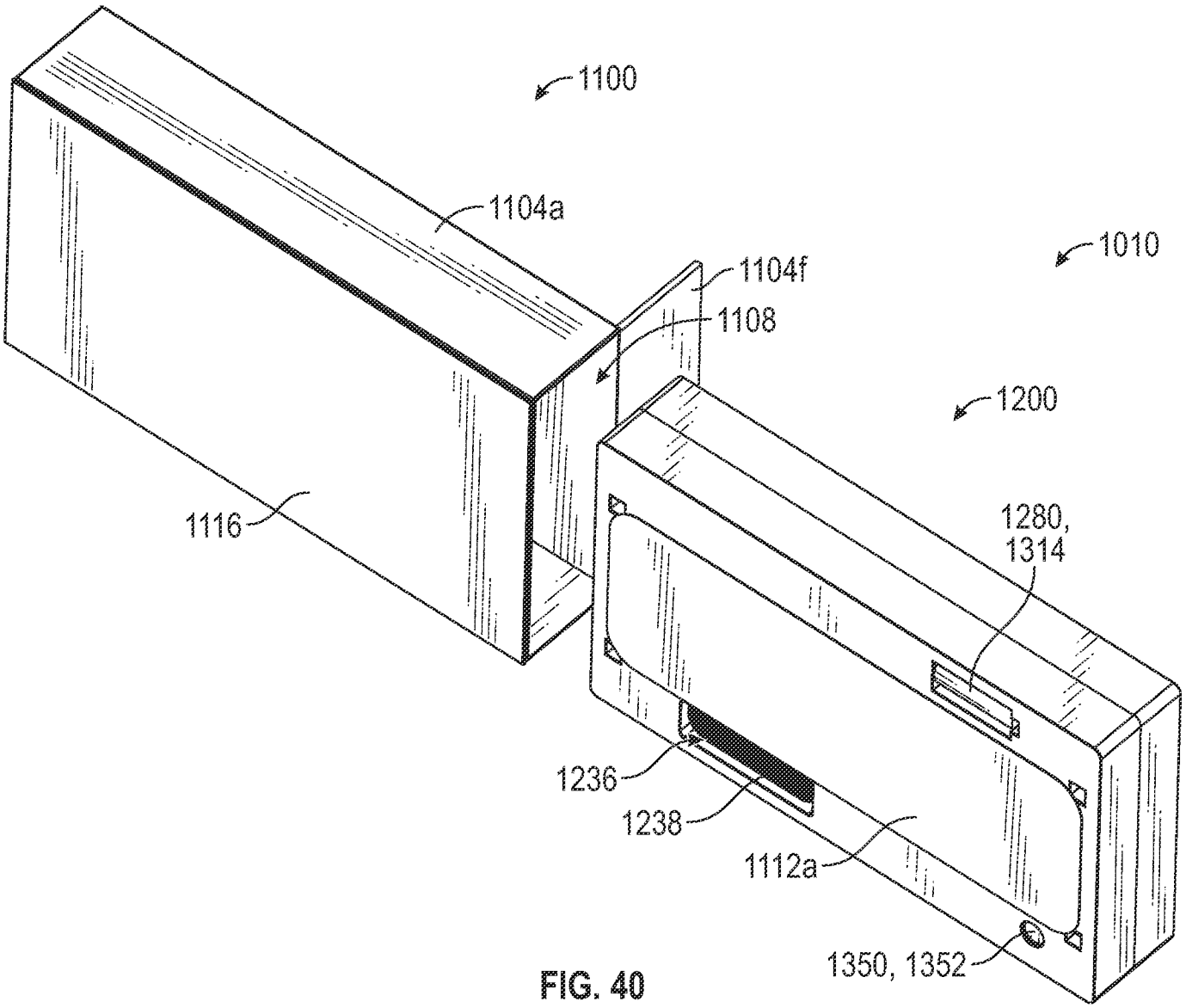
FIG. 40 is a fourth exploded view of the product package of FIG. 23, wherein the support assembly, the product retainer and the product are ready for insertion into the housing.
Figure 41:
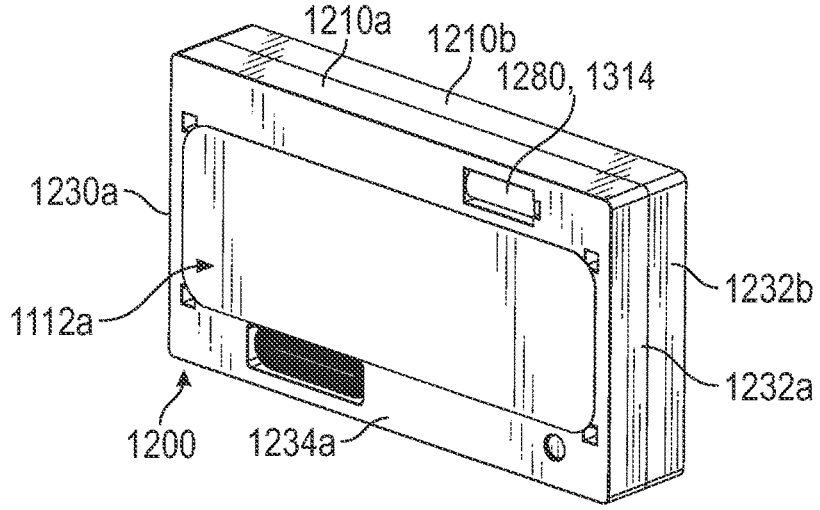
FIG. 41 is a perspective view of the support assembly of FIG. 40.
Figure 42:
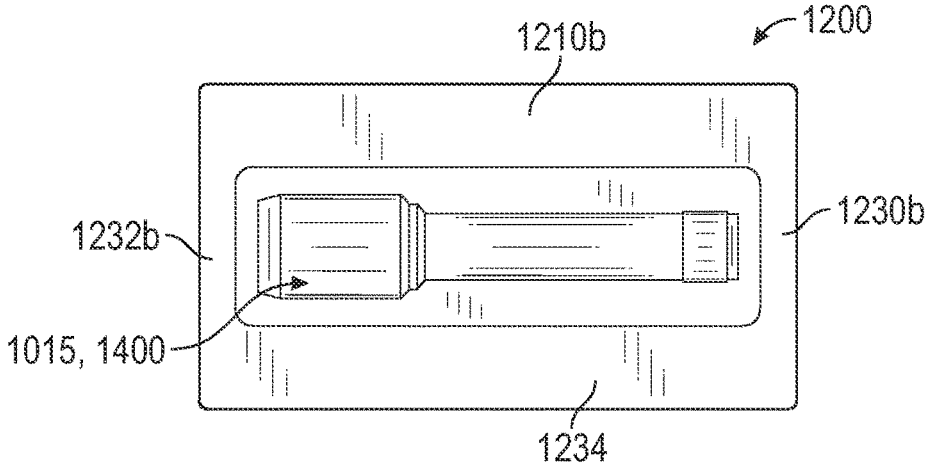
FIG. 42 is a rear view of the support assembly of FIG. 40.
Figure 43:
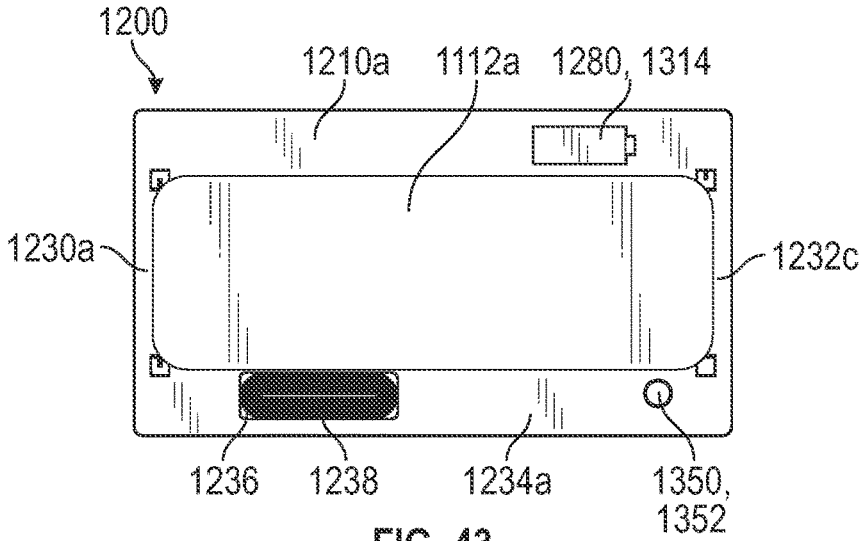
FIG. 43 is a front view of the support assembly of FIG. 40.
Figure 44A:
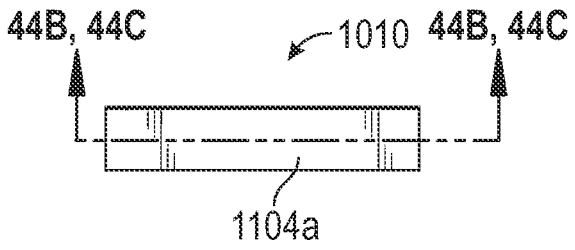
FIG. 44A is a top view of the product package of FIG. 23.
Figure 44B:
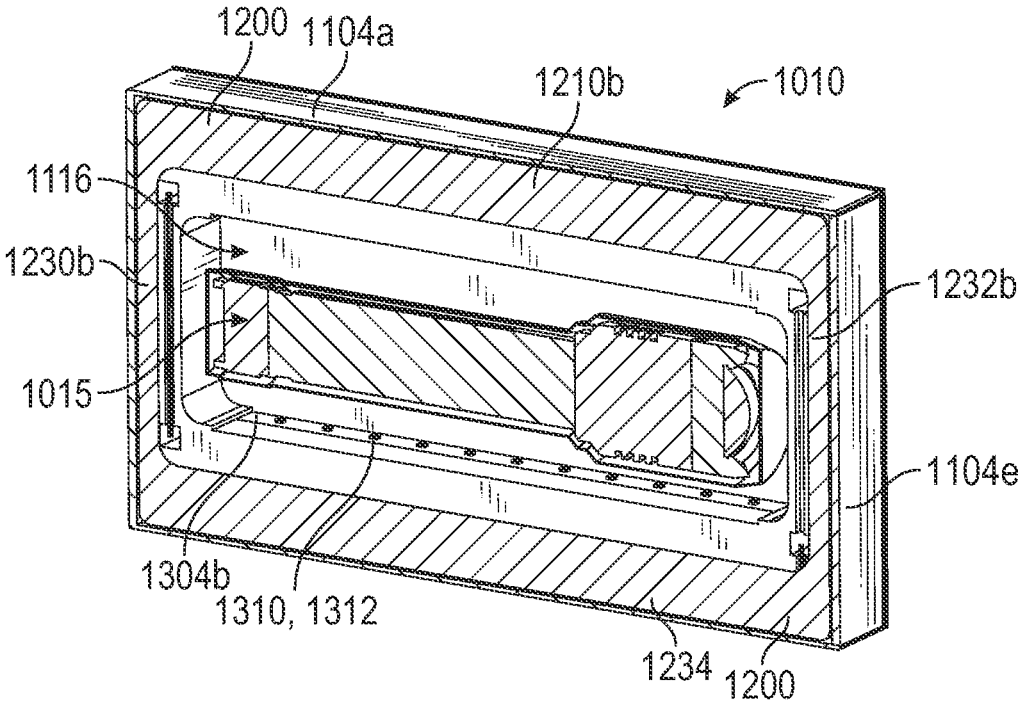
FIG. 44B is a cross-sectional perspective view of the product package of FIG. 44A taken along line 44B-44B.
Figure 44C:
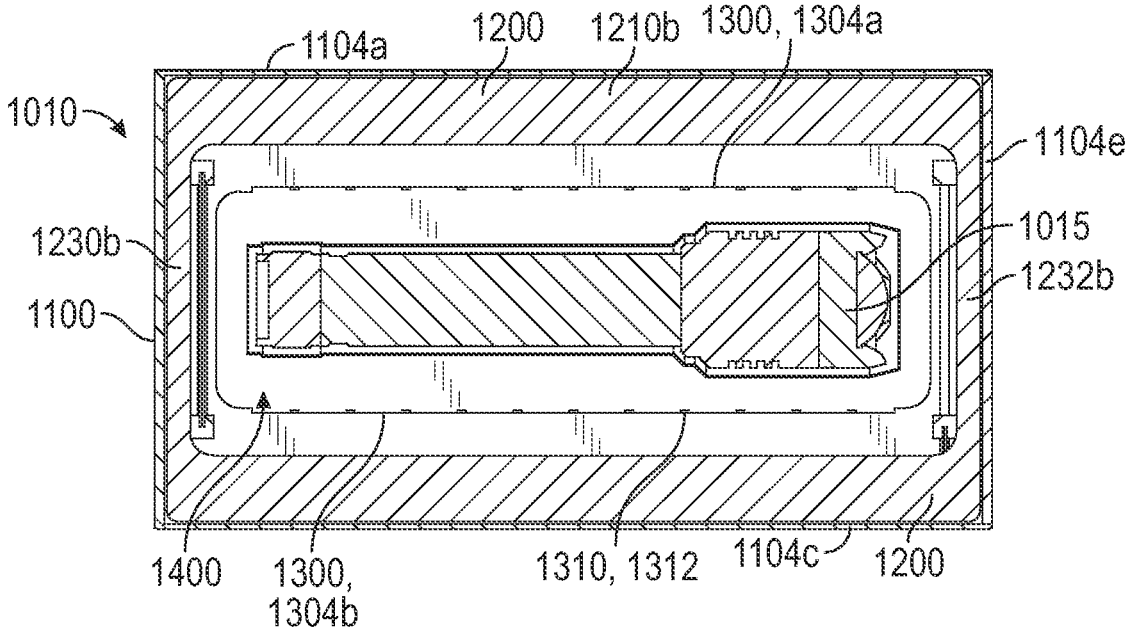
FIG. 44C is a cross-sectional perspective view of the product package of FIG. 44A taken along line 44C-44C.
Figure 45:
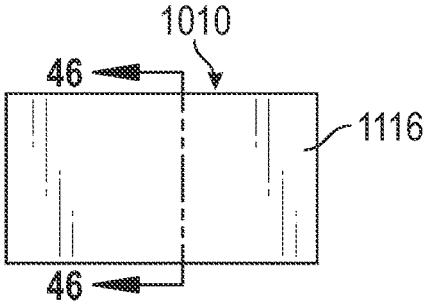
FIG. 45 is a front view of the product package of FIG. 23.

FIGS. 21 and 22B show select ray traces that represent the light that is emitted from the light emitters 310. As shown in these Figures, the back wall 104*b* of the housing 100 and the inner surfaces of the support structures 230, 232 act as reflecting surfaces in order to illuminate the product 15. In addition, the positioning of the light emitters 310 allows some of the light to be reflected off the product 15. Further, the positioning of the product 15 and the light emitters 310 is configured such that a limited amount of light can escape directly out of the display window 112 without being reflected off of a surface. This configuration helps backlight the product and ensure that the potential buyer has a pleasant viewing experience because the light is emitted is not directly shined into the potential buyer's eyes. In other embodiments, the light emitters 310 may be placed in a different location or arranged in a different manner than the manner shown here. However, the designer of these alternative embodiments should try to minimize the amount of light that can exit the display window 112 without reflecting off a surface. For example, if the designer moves the light emitters 310 closer to the front wall 212*a*, then the design should angle away from the display window (e.g., towards back wall 104*b* and/or support structures 230, 232).

In this embodiment shown in FIGS. 1-22B, the illumination assembly 300 does not have a secondary optic and the transparent cover 112*a* of the display window 112 acts as a primary optic for the packaging 10. It should be understood that different types of light emitters 310 may be utilized, such: (i) a standard LED, (ii) organic LED, (iii) induction light panel, (iv) silicon quantum dot phosphor (SiQD-phosphor), or (v) COB. Further, it should be understood that a combination of the different types of light emitters 310 may be utilized. For example, one light emitter 310 may be a surface-mounted LED, while other light emitter 310 may be COB LEDs. It should also be understood, that transparent cover 112*a* may also be omitted and in this configuration, there is no primary optic and no secondary optic.

The power source 314 may be any type of suitable power source. For example, the power source 314 may be a removable non-rechargeable battery, a removable rechargeable battery, a plurality of removable rechargeable batteries, a plurality non-removable rechargeable batteries, a plurality of removable batteries disposed within a battery cartridge, a one or more non-removable rechargeable battery, a one or more non-removable non-rechargeable battery, a wireless electrical receiver, or any combination of these components. In this embodiment, power source 314 is a combination of two removable non-rechargeable batteries that are AAA. However, it should be understood that different numbers and sizes of batteries may be utilized (e.g., 3 or 15 batteries, 1 battery, larger batteries AA, C, D, or smaller batteries AAAA). Finally, the wireless electrical receiver may be utilized in a manner that does not require a battery. In this configuration, a wireless transmitter may be built into the display case and is connected to a larger power supply (e.g., directly to 110-volt outlet or a large battery pack). The wireless transmitter then transmits power to the wireless receivers that are housed within the packages 10. This power can then be utilized to illuminate the light emitters 310. This design eliminates the need for the battery compartment 280, some of the wires, and batteries contained within the packaging 10.

The switching means 350 is electrically coupled to the PCB 304 via wires (not shown). As described above, the switching means 350 in this embodiment is a metal disk 352 that is designed to be releasably coupled to the trigger means 120 or magnet 122. When the switching means 350 is coupled to the trigger means 120 (this occurs in the closed position), the electrical circuit is open and power is not permitted to flow from the power source 314 to the light emitters 310. Alternatively, when the switching means 350 is not coupled to the trigger means 120 (this occurs in the partially open or open position), the electrical circuit is closed and power is permitted to flow from the power source 314 to the light emitters 310. Thus the interaction between the switching means 350 and the trigger means 120 turns on or off the illumination assembly 300.

Products 15 shown in connection with FIGS. 1-22B are broadheads or arrow tips, which are described in greater detail within Ser. No. 16/275,306, which is incorporated herein by reference. As shown in these figures, there are multiple (e.g., 3) identical products that are coupled to the support structure 200 via a threaded engagement. It should be understood that in other embodiments, the product package 10 may contain multiple products 15 that are: (i) not identical, but are similar (e.g., multiple flashlights), (ii) multiple products 15 that are dissimilar (e.g., flashlight and a bottle opener), or (iii) a single product 15.

In summary, the packaging 10 has many different and unique features that are designed to attract and retain a potential buyer's attention. Some of these features are: (i) hologram contained on the concealing flap 116, (ii) a reveal type package that has a display window 112, wherein the product 15 can be selectively illuminated by an illumination assembly 300, and (iii) a plurality of light emitters 310 that are dispersed between a plurality of products 15 and positioned towards the rear of the package 10 in order to backlight and illuminate features of the plurality of products 15. Additionally, the packaging 10 is designed to be used only one time and thus the structure and function of the packaging 10 have been designed with this in mind. Some of the features that aid in the single time use design are: (i) coupling the illumination assembly 300 to the support assembly 200 instead of coupling the illumination assembly 300 to the housing 100, (ii) using materials that are designed to be disposed of after use (e.g., plastic and heavy-duty paper product), (iii) using non-rechargeable batteries in connection with the power source 314, (iv) unique placement of the light emitters 310 to highlight specific features of the products 15 (e.g., bottom and backlit instead of edge-lit), and (v) is durable enough to withstand use over multiple years, which reduces costs to manufacture the packaging 10 and the shipping weight of the packaging 10.

Similar to the packaging 10 as described above, FIGS. 23-48 show another embodiment of a packaging 1010. The packaging 1010 can also selectively illuminate the product 1015. For sake of brevity, the above disclosure in connection with package 10 will not be repeated below, but it should be understood that across embodiments like numbers represent like structures. For example, the disclosure relating to illumination assembly 300 applies in equal force to illumination assembly 1300. Further, it should be understood that the operational modes of the package 1010 are similar to, or identical to, those disclosed regarding package 10. Moreover, it is to be understood that any one or more features of the package 10 can be used in conjunction with those disclosed regarding the package 1010, and that any one or more features of the package 1010 can be used in conjunction with those disclosed regarding the package 10.

The primary differences between package 10 and package 1010 is: (i) there is only one product 1015 that is present within the package 1010, (ii) the single product 1015 is illuminated from the edges and front, (iii) there are two PCBs 1304*a*, 1304*b*, (iv) there are more than four light emitters 1310 and the emitters 1310 are not positioned underneath the top wall 212*b* of the base structure 210, (v) light emitters 1310 are not dispersed between multiple products, and (vi) the support assembly 1200 is formed in two pieces 1202*a*, 1202*b* in order to receive a product retainer 1400 instead of directly coupling the products 15 to the support assembly 200. These primary differences are focused on adapting the packaging 10 for containing a plurality of smaller products 15 to a package 1010 that is designed to house a single larger product 1015. As such, similar other changes are contemplated by this disclosure.

Figure 46:
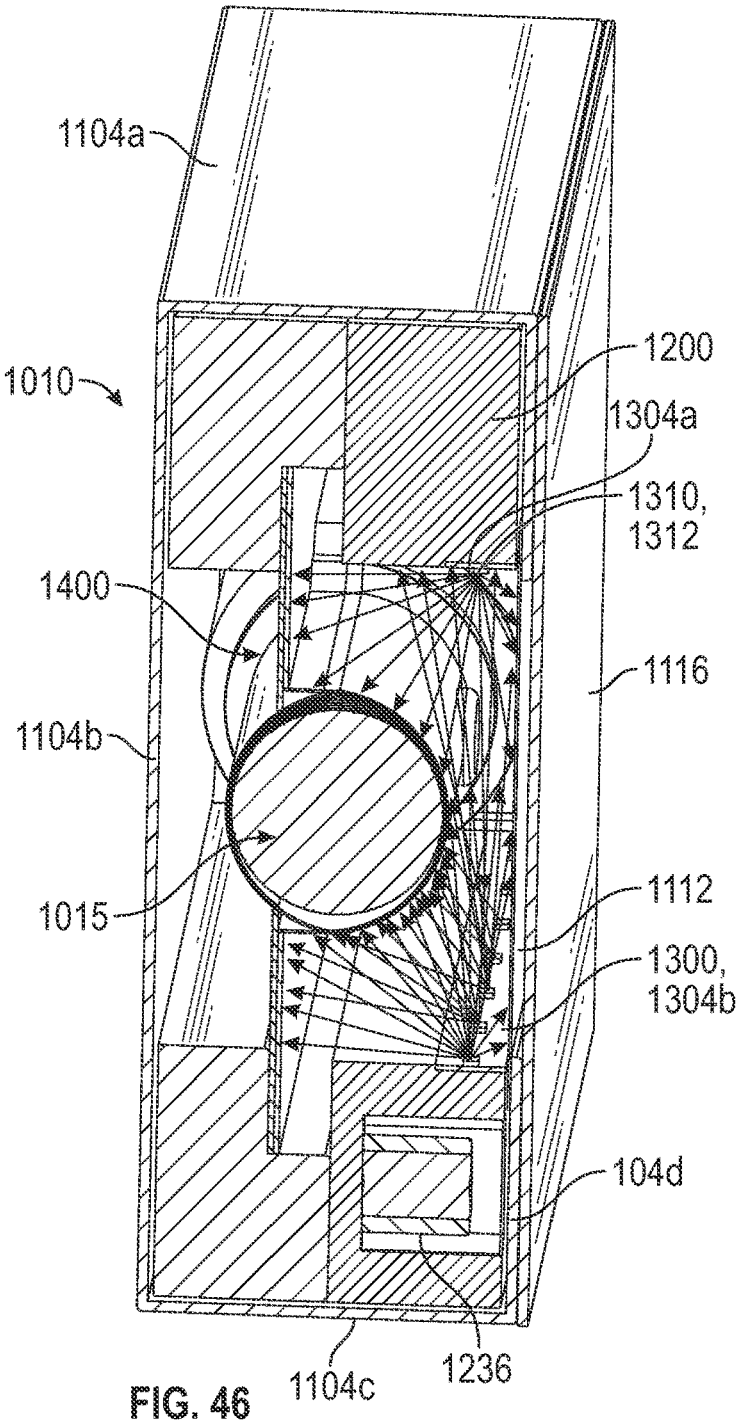
FIG. 46 is a cross-sectional perspective view of the product package of FIG. 45 taken along line 46-46 and showing ray traces emitted by the illumination assembly.
Figures 47, 48:
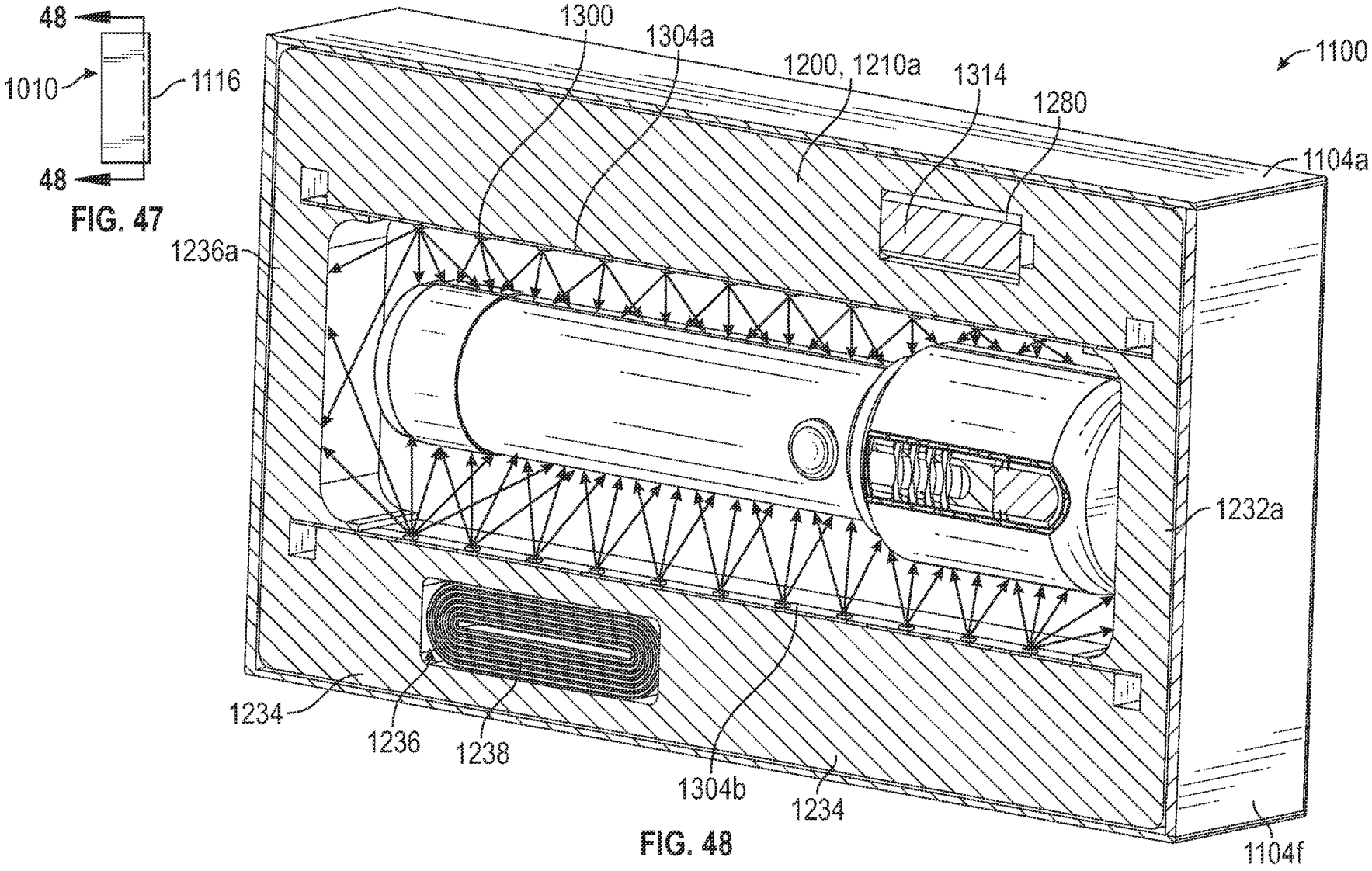
FIG. 47 is a left side view of the product package of FIG. 23.
FIG. 48 is a cross-sectional perspective view of the product package of FIG. 47 taken along line 48-48 and showing ray traces emitted by the illumination assembly.

The product retainer 1400 includes two primary components: (i) a first holder component 1404 and (ii) a second holder component 1406. The first holder component 1404 has: (i) a receiver 1408 that is designed to receive an extent of the product 1015 and (ii) a projection 1410 that extends from the receiver 1408. As best shown in FIG. 46, the projection 1410 is designed to reside between an extent of the pieces 1202*a*, 1202*b* of the support assembly 1200. This projection 1410 is typically made from cardboard or any other suitable material. The second holder component 1406 is designed to abut and be coupled to the receiver 1408, which in turn ensures that the product 1015 is retained in the proper location within the display window 1112. It should be understood that there are other methods of securing the product 1015 to the support assembly 1200, some of which are discussed above.

In this embodiment and as discussed above in an alternative embodiment, the size, weight, and configuration of the product required the inclusion of an upper rectangular structure 1234*a*, 1234*b* that extends between the support structures 1230*a*, 1232*a*, 1230*b*, 1232*b*. This upper rectangular structure 1234*a*, 1234*b* is similar to the lower rectangular structure 1210*a*, 1210*b* and even includes a receiver 1236 that is formed therein to receive a rechargeable cable 1238. This additional upper rectangular structure 1234*a*, 1234*b* will provide additional support and rigidity to the support assembly 1200 and to the product package 10.

The product 1015 that is contained within the packaging 1010 is a flashlight. Examples of other flashlights that may be included within this type of packaging are described within the following U.S. Pat. Nos. D752792, D759867, D809169, D858,830, D878,650, 10,598,319, 10,704,776, 10,760,754, each of which is incorporated herein by reference. It should be understood that other types of flashlights or other products such as training bows, jewelry, flowers, crystal glassware, electronics, phones, watches, pens, alcohol, perfumer, shoes or other consumer goods may be packaged within the product packaging 10, 1010 described herein.

In alternative embodiments, the packaging 10, 1010 may have unique security features such as a proximity sensors that will cause the product to become dysfunctional if it is moved outside of a certain area, RFID tags, GPS tracking capabilities, or other similar features. Additionally, the packaging 10, 1010 may include speakers or lights that may make a sound or illuminate when a potential buyer passes by the product due to the triggering of a motion sensor. Alternatively, this motion sensor may be built into the display and may trigger the lights that are contained within the individual packages upon the detection of motion. Further, the display may have a capability to monitor and recharge the batteries contained within the packages 10, 1010, if the batteries reach a state that does not allow them to properly illuminate the product 15, 1015. Moreover, it should be understood that the above disclosure is not limited to a reveal type package, but instead could apply to other types of packages. For example, the receiving means 350, 1350 may be built into the product display and illumination assembly 300, 1300 may be illuminated when a potential buyer removed the product package 10, 1010 from the display. Other embodiment, modifications, alterations, or configurations are contemplated by this disclosure and are obvious to one of skill in the art based on this disclosure and the associated Figures.

While the foregoing has described what are considered to be the best mode and/or other examples, it is understood that various modifications may be made therein and that the subject matter disclosed herein may be implemented in various forms and examples, and that the teachings may be applied in numerous applications, only some of which have been described herein. It is intended by the following claims to claim any and all applications, modifications and variations that fall within the true scope of the present teachings. Other implementations are also contemplated.

While some implementations have been illustrated and described, numerous modifications come to mind without significantly departing from the spirit of the disclosure; and the scope of protection is only limited by the scope of the accompanying claims. For example, when the support assembly 200, 1200 is removed from the container 208, 1208 and the packaging 10, 1010 has moved to the fully open position (shown in FIGS. 15 and 37-40), the illumination assembly 300, 1300 is typically configured remain illuminated. However, in an alternative embodiment, the illumination assembly 300, 1300 may have a secondary switch that is triggered to turn off the illumination assembly 300, 1300 when it is removed from the housing 100, 1100. This secondary switch may be similar to the trigger means 120 and the switching means 350, wherein a magnet is coupled to the inside of the front wall 104*d*, 1104*d* and a disk is coupled to the lower rectangular structure 210, 1210. Thus, removing the support structure 200, 1200 from the housing 100, 1100 will open the circuit and cause the illumination assembly to turn off. This may be desirable because it will help prevent the light that is emitted from the illumination assembly from shining into the buyer's eyes when the product is removed from the housing 100, 1100.

Headings and subheadings, if any, are used for convenience only and are not limiting. The word exemplary is used to mean serving as an example or illustration. To the extent that the term include, have, or the like is used, such term is intended to be inclusive in a manner similar to the term comprise as comprise is interpreted when employed as a transitional word in a claim. Relational terms such as first and second and the like may be used to distinguish one entity or action from another without necessarily requiring or implying any actual such relationship or order between such entities or actions.

Phrases such as an aspect, the aspect, another aspect, some aspects, one or more aspects, an implementation, the implementation, another implementation, some implementations, one or more implementations, an embodiment, the embodiment, another embodiment, some embodiments, one or more embodiments, a configuration, the configuration, another configuration, some configurations, one or more configurations, the subject technology, the disclosure, the present disclosure, other variations thereof and alike are for convenience and do not imply that a disclosure relating to such phrase(s) is essential to the subject technology or that such disclosure applies to all configurations of the subject technology. A disclosure relating to such phrase(s) may apply to all configurations, or one or more configurations. A disclosure relating to such phrase(s) may provide one or more examples. A phrase such as an aspect or some aspects may refer to one or more aspects and vice versa, and this applies similarly to other foregoing phrases.

Numerous modifications to the present disclosure will be apparent to those skilled in the art in view of the foregoing description. Preferred embodiments of this disclosure are described herein, including the best mode known to the inventors for carrying out the disclosure. It should be understood that the illustrated embodiments are exemplary only, and should not be taken as limiting the scope of the disclosure.

We claim:

1. A product package with an internal illumination assembly, the product package comprising:

a housing including an arrangement of walls that define a container, a movable concealing segment and at least one display window;

a support assembly removably positioned within the container;

at least one product removably coupled to the support assembly;

an illumination assembly coupled to the support assembly, the illumination assembly configured to selectively illuminate the product;

wherein when the housing is in a closed position, the concealing segment overlies the display window to obscure the product and the illumination assembly is not illuminating the product; and wherein when the housing is in a partially open position, the concealing segment is deployed from the display window to expose the product while the illumination assembly is illuminating the product, and a major extent of the support assembly is not visible through the display window.

2. The product package of claim 1, wherein the product is not accessible when the housing is in the partially open position.

3. The product package of claim 1, wherein a plurality of products are coupled to the support assembly;

wherein the illumination assembly includes a plurality of light emitters; and wherein at least one light emitter from the plurality of light emitters is positioned between a pair of products from the plurality of products.

4. The product package of claim 1, wherein both the support assembly and the product are removed from the housing when the housing is in a fully open position.

5. The product package of claim 1, wherein the concealing segment includes a triggering means and the illumination assembly includes a switching means; and wherein the triggering means is coupled to the switching means when the housing is in the closed position; and wherein the triggering means is uncoupled from the switching means when the housing is in the partially open position or a fully open position.

6. The product package of claim 5, wherein the interaction between the triggering means and the switching means applies a biasing force on the movable flap to retain the movable flap in contact with a front wall of the housing.

7. The product package of claim 6, wherein an uncoupling force must be applied on the concealing segment that is greater than the biasing force in order to move the housing from the closed position to the partially opened position.

8. The product package of claim 1, wherein the support assembly includes either: (i) a horizontal reflecting surface located below the product to facilitate illumination of the product in the partially open position, or (ii) at least one vertical reflecting surface located adjacent to the product that facilitates illumination of the product in the partially open position.

9. The product package of claim 1, wherein the support assembly is not visible through the display window in the partially open position when the package is viewed on-center.

10. The product package of claim 1, wherein the product package is a one-time use package intended to be discarded after purchase of the product package by a buyer.

11. A product package with an internal illumination assembly, the product package comprising:

a housing including an arrangement of walls that define a container, the housing also including a movable concealing flap;

a support assembly removably positioned within the container, the support assembly including an illumination assembly;

at least one product coupled to the support assembly;

wherein when the housing is in a closed position, the concealing flap obscures the product from view and the illumination assembly is not illuminating the product; and wherein when the housing is in a partially open position, the concealing flap is deployed from the housing to expose the product and the illumination assembly is illuminating the product; and wherein the support assembly includes a horizontal reflecting surface located below the product to facilitate illumination of the product in the partially open position.

12. The product package of claim 11, wherein the product is not accessible when the housing is in the partially open position.

13. The product package of claim 11, wherein a plurality of products are coupled to the support assembly;

wherein the illumination assembly includes a plurality of light emitters; and wherein the plurality of light emitters are interspersed with the plurality of products.

14. The product package of claim 11, wherein the concealing flap includes a triggering means and the illumination assembly includes a switching means; and wherein the triggering means is coupled to the switching means when the housing is in the closed position; and wherein the triggering means is uncoupled from the switching means when the housing is in the partially open position or a fully open position.

15. The product package of claim 14, wherein the interaction between the triggering means and the switching means applies a biasing force on the movable flap to retain the movable flap in contact with a front wall of the housing.

16. The product package of claim 11, wherein the illumination assembly includes a light emitter that is positioned below an extent of the product.

17. The product package of claim 11, wherein the support assembly includes at least one vertical reflecting surface located adjacent to the product that facilitates illumination of the product in the partially open position.

18. The product package of claim 11, wherein a major extent of the support assembly is not visible through the display window in the partially open position.

19. The product package of claim 11, wherein the support assembly is not visible through the display window in the partially open position when the package is viewed on-center.

20. A product package with an internal illumination assembly, the product package comprising:

a housing including an arrangement of walls that define a container, a movable concealing flap and at least one display window;

a support assembly removably positioned within the container;

an illumination assembly coupled to the support assembly;

wherein when the housing is in a closed position, the concealing flap overlies the display window and the illumination assembly is not illuminating;

wherein when the housing is in a partially open position, the concealing flap is deployed from the display window and the illumination assembly is illuminating;

wherein the support assembly includes a horizontal reflecting surface to facilitate illumination of a product in the partially open position; and, wherein when the housing is in a fully open position, the support assembly is removed from the housing.

21. The product package of claim 20, wherein the product is accessible when the housing is in the fully open position.

22. The product package of claim 20, wherein the illumination assembly continues to illuminates the product when the housing is in the fully open position.

23. The product package of claim 20, wherein the concealing flap includes a triggering means and the illumination assembly includes a switching means; and wherein the triggering means is coupled to the switching means when the housing is in the closed position; and wherein the triggering means is uncoupled from the switching means when the housing is in the partially open position or a fully open position.

24. The product package of claim 23, wherein the interaction between the triggering means and the switching means applies a biasing force on the movable flap to retain the movable flap in contact with a front wall of the housing.

25. The product package of claim 20, wherein the support assembly is a free-standing component that is configured to self-support a product in the fully open position.

26. The product package of claim 20, wherein the support assembly includes at least one vertical reflecting surface that facilitates illumination of the product in the partially open position.

27. The product package of claim 20, wherein a major extent of the support assembly is not visible through the display window in the partially open position.

* * * * *